US006016730A

United States Patent [19]

Tsuzaki et al.

[11] Patent Number: 6,016,730

[45] Date of Patent: Jan. 25, 2000

[54] PERFORATOR

[75] Inventors: Hiroshi Tsuzaki; Takeshi Kanaoka; Junichi Tsuchiya; Susumu Sato, all of Kanagawa, Japan

[73] Assignee: Fuji Photo Film Co., Ltd., Kanagawa, Japan

[21] Appl. No.: 08/917,462

[22] Filed: Aug. 26, 1997

Related U.S. Application Data

[62] Division of application No. 08/704,977, Aug. 28, 1996, Pat. No. 5,746,100, which is a division of application No. 08/162,299, Dec. 7, 1993, abandoned.

[30] Foreign Application Priority Data

Dec. 7, 1992 [JP] Japan ..... 4-326981
Dec. 9, 1992 [JP] Japan ..... 4-329506

[51] Int. Cl.[7] ..... B26D 5/20

[52] U.S. Cl. ..... 83/76.1; 83/620; 83/948

[58] Field of Search ..... 83/76.1, 76.6, 83/76.9, 278, 423, 620, 622, 660, 39, 40, 42, 48, 50, 52, 687, 691, 948, 13, 30; 234/39, 94, 95, 106, 107, 130, 1, 2; 226/76; 396/661

[56] References Cited

U.S. PATENT DOCUMENTS

| | | |
|---|---|---|
| 2,695,668 | 11/1954 | Roth . |
| 3,177,749 | 4/1965 | Best et al. . |
| 3,656,384 | 4/1972 | Chandler . |
| 3,738,569 | 6/1973 | Killaly, Sr. . |
| 4,574,563 | 3/1986 | Shimizu . |
| 4,747,895 | 5/1988 | Wallerstein et al. . |
| 4,846,418 | 7/1989 | Fairman . |
| 4,860,037 | 8/1989 | Harvey . |
| 4,928,562 | 5/1990 | Tanimura et al. . |
| 4,989,483 | 2/1991 | Lacrouts-Cazenave . |
| 5,106,017 | 4/1992 | Hicks . |
| 5,157,439 | 10/1992 | Sakamoto et al. . |
| 5,188,270 | 2/1993 | Hiramatsu et al. . |
| 5,265,506 | 11/1993 | Aihara et al. . |
| 5,461,450 | 10/1995 | Long et al. . |

FOREIGN PATENT DOCUMENTS

| | | |
|---|---|---|
| 0329172 | 8/1989 | European Pat. Off. . |
| 1530062 | 5/1968 | France . |
| 4135787 | 5/1992 | Germany . |
| 61-214999 | 9/1986 | Japan . |
| 42800 | 1/1992 | Japan . |
| 496056 | 3/1992 | Japan . |

*Primary Examiner*—Kenneth E. Peterson
*Attorney, Agent, or Firm*—Sughrue, Mion, Zinn, Macpeak & Seas, PLLC

[57] ABSTRACT

A perforator for making perforations in a continuous film which is thereafter cut into individual filmstrips having variable lengths. A die set unit of the perforator has a plurality of punches and corresponding dies which are respectively arranged along the continuous film. The die set unit performs die-punching N times (N=1, 2, 3 . . . ) in every first section having a variable length Lx, and the measuring feeder transports the continuous film by a first length after each of (N−1) times die-punching and by a second length after the last die-punching for every first section. The first length is given as Lx/N, and the second length corresponds to the first length plus the length L2 of a second section disposed alternately with the first section along the continuous film. In alternative, the die set unit is constituted of first to nth die sets aligned in order from downstream to in the film transporting direction. The ith die set of the die sets has a number Gi (i=1, 2 . . . n) of punches as a segment of the total punches. The first to ith die sets are simultaneously activated to perform die-punching. The number is selected depending on the number F of frame exposure locations to be provided in each individual filmstrip.

4 Claims, 22 Drawing Sheets

PERFORATOR

This is a divisional of application Ser. Nos. 08/704,977 filed Aug. 28, 1996, now U.S. Pat. No. 5,746,001, which is a divisional of application Ser. No. 08/162,299, filed Dec. 7, 1993, now abandoned.

BACKGROUND OF THE INVENTION

1. Field of the Invention

The present invention relates to a perforator for making perforations along at least one lateral side of a continuous strip of photographic film, or the like, within a limited longitudinal section thereof.

2. Description of the Related Art

Conventional 35 mm, or 135-type, photographic film (ISO 135: 1979) has perforations formed at constant intervals along the entire length thereof, for example, as shown in FIG. 25. Perforators for making such continuous perforations 10 are disclosed in JPA 61-214999 and JPU 4-2800, for example.

Known perforators have a measuring feeder for feeding the continuous film by a given length into a die set mechanism. The die set mechanism sandwiches the fed portion of the continuous film to die-punch the same and thus simultaneously form a predetermined number of perforations in the film. The perforations are equally spaced in the film feeding or transporting direction. The measuring feeder and the die set mechanism are synchronously driven by a common drive source through respective drive systems. At least one of these drive systems is coupled to the drive source through a cam index mechanism. Thereby, the interval of die-punching of the die set mechanism is controlled to be constant, and the measuring feeder feeds the continuous film by a length corresponding to the predetermined number of perforations. In this way, the equally spaced perforations 10 are formed in continuous succession. Thereafter, the continuous film 11 is cut into individual filmstrips 13 as shown by phantom lines in FIG. 25. Picture frames are exposed or recorded in proper locations 12 by advancing the filmstrip 13 by one-frame amount after each exposure in a camera. The perforations 10 have mainly been utilized for such a one-frame film advancement.

Recently, a photographic filmstrip has been disclosed, for example, in JPA 4-96056, that has one perforation for each frame exposure location along one or both lateral sides thereof. For example, as shown in FIG. 26, a perforation 14 is disposed on each lateral side of each frame exposure location 12 of an individual filmstrip 15. This type photographic filmstrip is mainly directed for use in a film cassette having a film leader advancing function, in which a film leader of the filmstrip entirely located within the cassette can be advanced to the outside of the cassette by rotating a spool of the cassette. Such a film cassette is disclosed, for example, in U.S. Pat. No. 4,846,418. Therefore, a camera for use with this type film cassette does not need a conventional film advancing sprocket, and instead, adopts an optical sensor for detecting the perforations 14 to determine and position the frame exposure location 12 in an exposure opening of the camera.

For this reason, the perforations 14 are merely formed in a longitudinal section extending from the first to the last frame exposure location 12 of each filmstrip 15. This section will be hereinafter referred to as effective frame recording section 1 or simply section 1. A section which does not have frame exposure locations 12 and hence does not have frame positioning perforations 14 will be referred to as ineffective frame recording section 2 or simply section 2, as indicated in FIG. 26.

The perforations 14 of the above-described new arrangement cannot be made by the above-described conventional perforator.. This is because the measuring feeder and the die set mechanism are synchronously driven by the same drive source, so that it is impossible to change the drive pattern of the measuring feeder or the die set mechanism independently from one another to thereby allow a position of the film to be advanced without perforation.

Conventional 110-type photographic filmstrips also have perforations which are disposed one for each frame exposure location, and are therefore disposed merely within effective recording sections. A perforator for the 110-type filmstrip conventionally uses a die set mechanism having punches and dies of a number corresponding to a predetermined frame number of the individual filmstrip. All the perforations of the predetermined number are thus provided simultaneously by a die-punching stroke of the die set.

However, there are usually several variations in the number of picture frames available on one filmstrip. Therefore, the above-described 110-type perforator needs to prepare several kinds of die sets in order to correspond to the frame number variation of the filmstrips to be manufactured. The cost of the die sets is substantial. Also, it is necessary to interrupt running the perforator so as to interchange the die set mechanisms each time the frame member format is changed. This results is lowering the efficiency of the perforator.

SUMMARY OF THE INVENTION

In view of the foregoing, an object of the present invention is to provide a perforator which can make perforations only in the effective frame recording section 1 by separately controlling a measuring feeder and a die set mechanism.

Another object of the present invention is to provide a perforator which does not require die sets to be interchanged each time the frame number format of the filmstrips is to be changed.

A further object of the present invention is to provide a perforator which is compact and economical to manufacture and operate.

To solve the above and other objects, a perforator of the present invention has a die set unit having a plurality of punches and corresponding dies which are respectively arranged along the length of continuous film transported therethrough, a measuring feeder for feeding the continuous film into the die set unit by a given variable length and a control unit for controlling the measuring feeder and the die set unit independently from one another to make perforations in a first section of the continuous film, and avoid making perforations in a second section which is arranged alternatively with the first section along the continuous film. The first section has a variable length Lx variable in correspondence with the variable length of the individual filmstrips, and the second section has a constant length L2.

According to a first embodiment, the die set unit performs die-punching N times (N=1, 2, 3 . . . ) in each first section, and the measuring feeder transport the continuous film by a first length after each of (N−1) times die-punching and by a second length after the last die-punching for each first section. The first length is given as L×/N, and the second length corresponds to the first length plus the length L2 of the second section. The number N of die-punching operations depends on the number F of frame exposure locations to be provided in each individual filmstrip.

According to a first drive pattern of the first embodiment, the control unit maintains the die-punching interval of the die set unit constant, and also maintains transporting time of the measuring feeder constant after each die-punching, but the changes transporting speed in accordance with the change between the first length and the second length.

According to a second drive pattern of the first embodiment, the control unit maintains the transporting speed of the measuring feeder constant, but changes the die-punching interval of the die set unit and transporting time of the measuring feeder in accordance with the change between the first length and the second length.

In a second embodiment of the invention, the die set unit is constituted of first to nth die sets aligned in this order from downstream in the film transporting direction. The ith die set of the die sets has a number Gi (i=1, 2, . . . n) of punches as a segment of the total punches, and the first to ith die sets are simultaneously activated to perform die-punching. The number i is selected by the control unit in accordance with the number F of frame exposure locations to be provided in each individual filmstrip.

BRIEF DESCRIPTION OF THE DRAWINGS

Other objects and advantages of the present invention will become apparent in the following detailed description of the preferred embodiments when read in connection with the accompanying drawings, wherein like reference numerals designates like or corresponding parts throughout the several views, and wherein.

DESCRIPTION OF THE PREFERRED EMBODIMENTS

Figure 1:
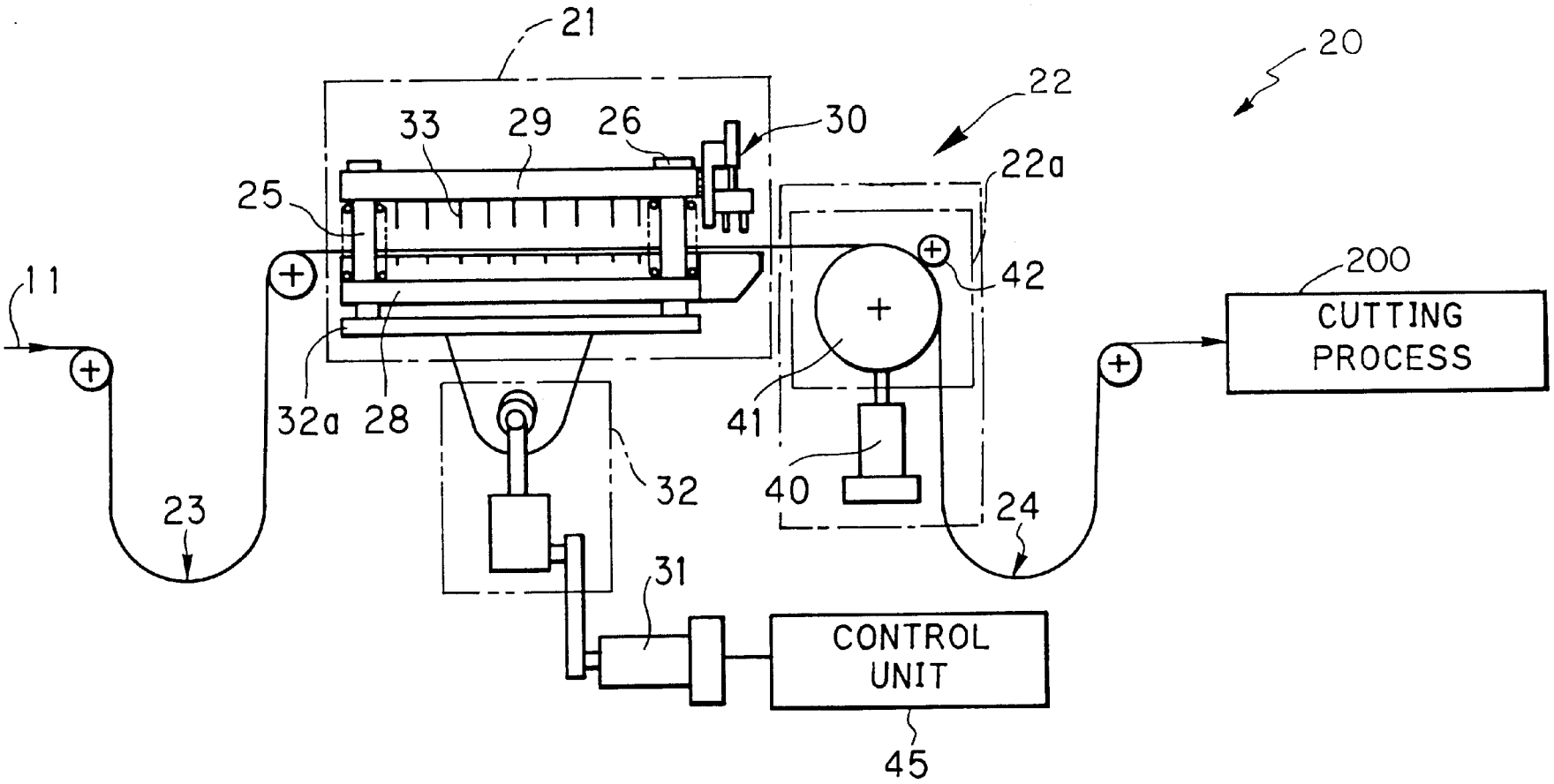
FIG. 1 schematically shows a perforator according to a first preferred embodiment of the invention.

As shown in FIG. 1, a perforator 20 is constituted of a die set unit 21 and a measuring feeder 22. Loop chambers 23 and 24 are disposed before and after these mechanisms 21 and 22. A continuous strip of photographic film 11 is transported longitudinally through the die set unit 21 in a horizontal direction, and is fed to a cutting section 200 by way of the downstream loop chamber 24 to be cut into individual filmstrips.

Figure 2:
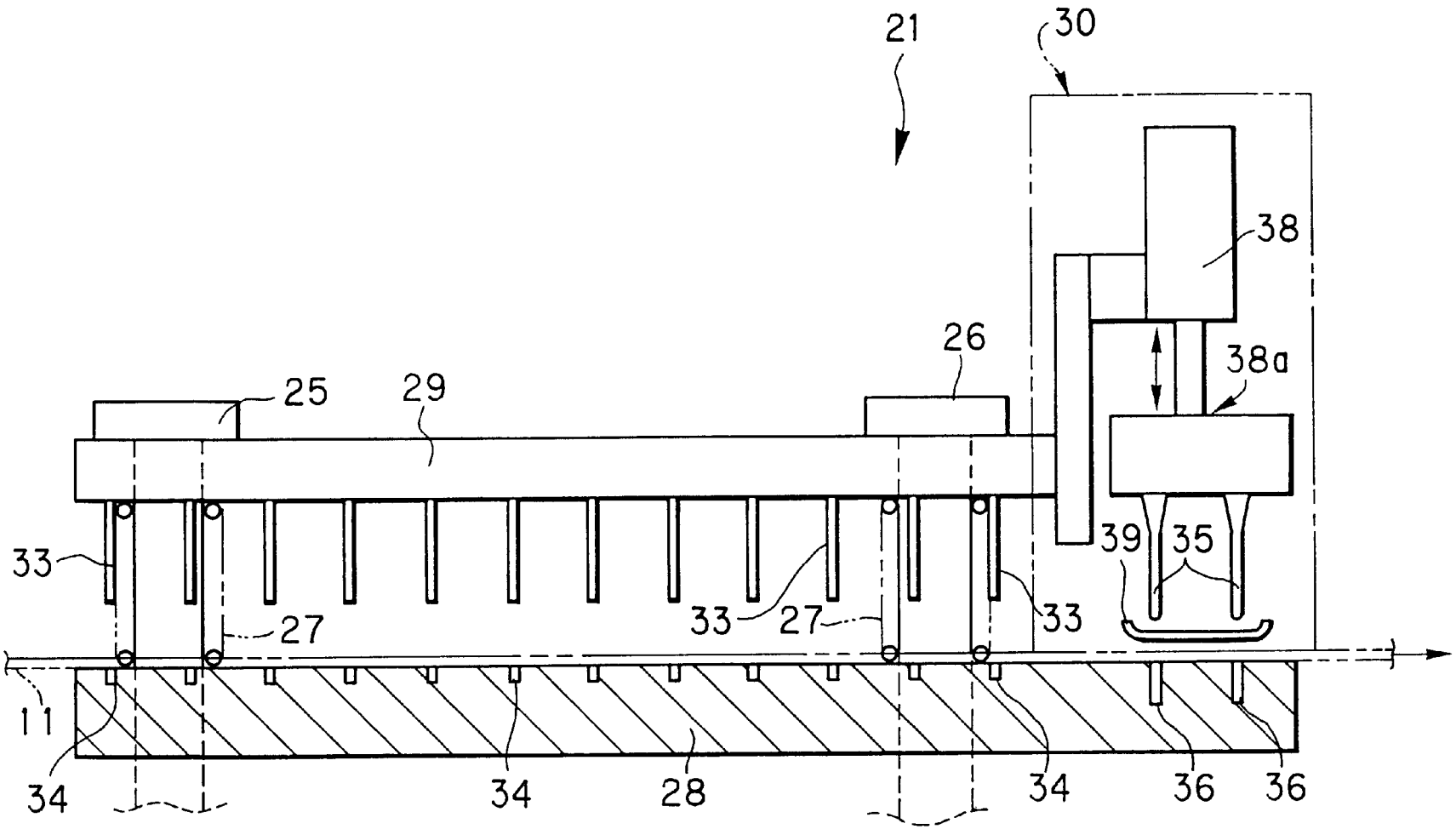
FIG. 2 is an explanatory view of a die set unit of the perforator shown in FIG. 1.

As shown in detail in FIG. 2, the die set unit 21 is constructed of a stationary base or die holder 28, a ram or punch holder 29 and a pilot pin mechanism 30. The punch holder 29 is movable in a vertical direction in the Figures relative to the die holder 28 together with a pair of guide pins 25 and 26 which are secured to a movable plate 32*a* (see FIG. 1). Springs 27 are mounted on the guide pins 25 and 26 so as to urge the punch holder 29 toward the retracted position. The movable plate 32*a* is vertically moved by a first motor 31 through a cam index mechanism 32 so as to move the punch holder 29 between a punching position and a retracted position in an intermittent fashion. Twelve pairs of punches 33 are secured to the punch holder 29. The two punches 33 of each pair are disposed on the opposite lateral sides of the continuous film 11 transported through the die set unit 21, and each pair is spaced at a constant interval from adjacent pairs in the film transporting direction, corresponding to the interval L1 of picture frames to be recorded, i.e., the interval of frame exposure locations 12.

The die holder 28 has twenty-four dies 34 formed therein in correspondence with the twenty-four punches 33 to receive the punches 33 when the punch holder 29 is in the punching position. The die holder 28 also has two pairs of recesses 36 for receiving two pairs of pilot pins 35 of the pilot pin mechanism 30. The two pairs of pilot pins 35 are aligned in the two lines of the punches 33, and spaced apart by the same interval L1 as the punch pairs in the film transporting direction.

The pilot pin mechanism 30 further includes a solenoid 38, a plunger 38*a* activated by the solenoid 38, and a stripper 39. The solenoid 38 is secured to the punch holder 29 on a downstream side thereof. The plunger 38*a* is moved by the solenoid 38 between a retracted position, where the plunger 38*a* retracts into the solenoid 38, and a projected position, where the plunger 38*a* projects from the solenoid 38 toward a film convey surface of the die holder 28. The pilot pins 35 are secured to the free end of the plunger 38*a* to move along the plunger 38*a* relative to the punch holder 29 between a retracted position, where the pilot pins 35 retract from the film convey surface, on one hand, and an engaging position, where the pilot pins 35 are engaged in the recesses 36 through perforations 14 of the continuous film 11 which have just been formed by die-punching.

Figure 3:
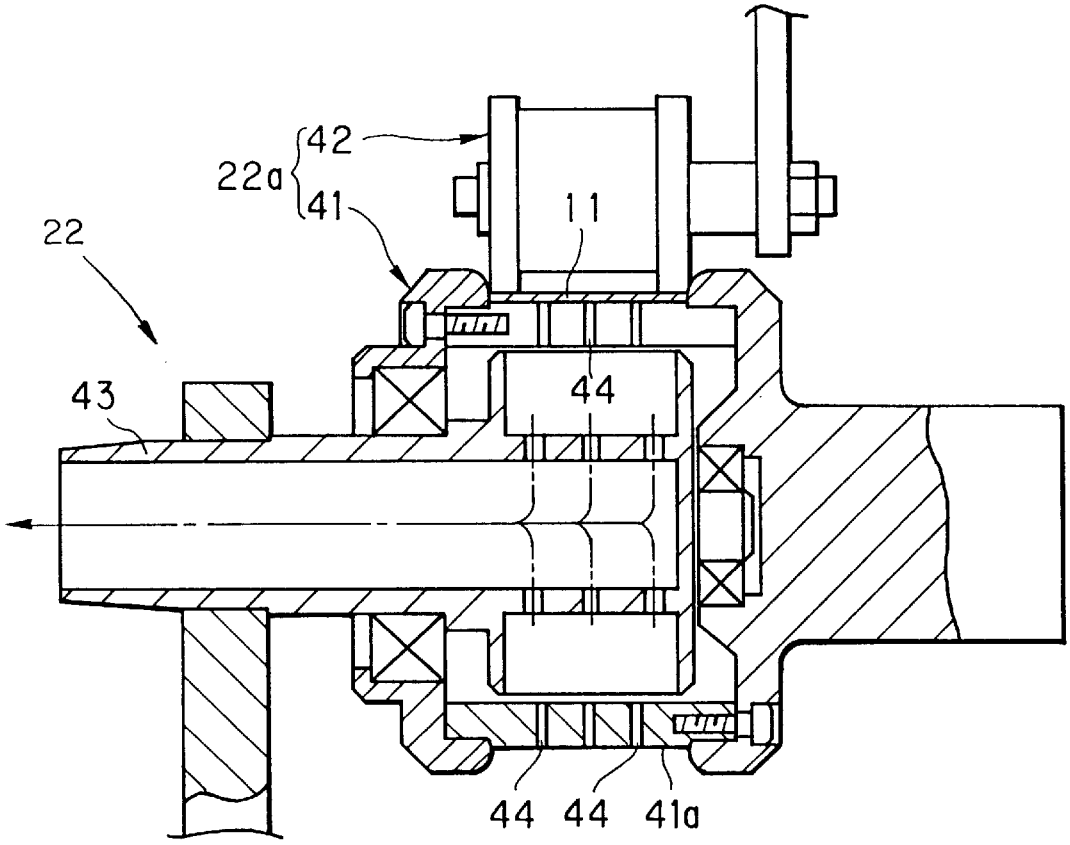
FIG. 3 is a sectional view of a measuring feeder of the perforator shown in FIG. 1.

Referring to FIG. 3, the measuring feeder 22 is constituted of a suction roller 41 driven by a second motor 40 (see FIG. 1), and a nip roller 42 for nipping the continuous film 11 at its edge portions between the suction roller 41 and the nip roller 42. Thereby, the continuous film 11 is fed by a predetermined length. The suction tube 43 is connected to an interior of the suction roller 41 to adhere the continuous film 11 onto an outer periphery 41a of the suction roller 41 by sucking the continuous film 11 through a large number of holes 44 which are formed through the outer periphery 41*a* of suction roller 41 (see FIG. 4).

Figure 5:
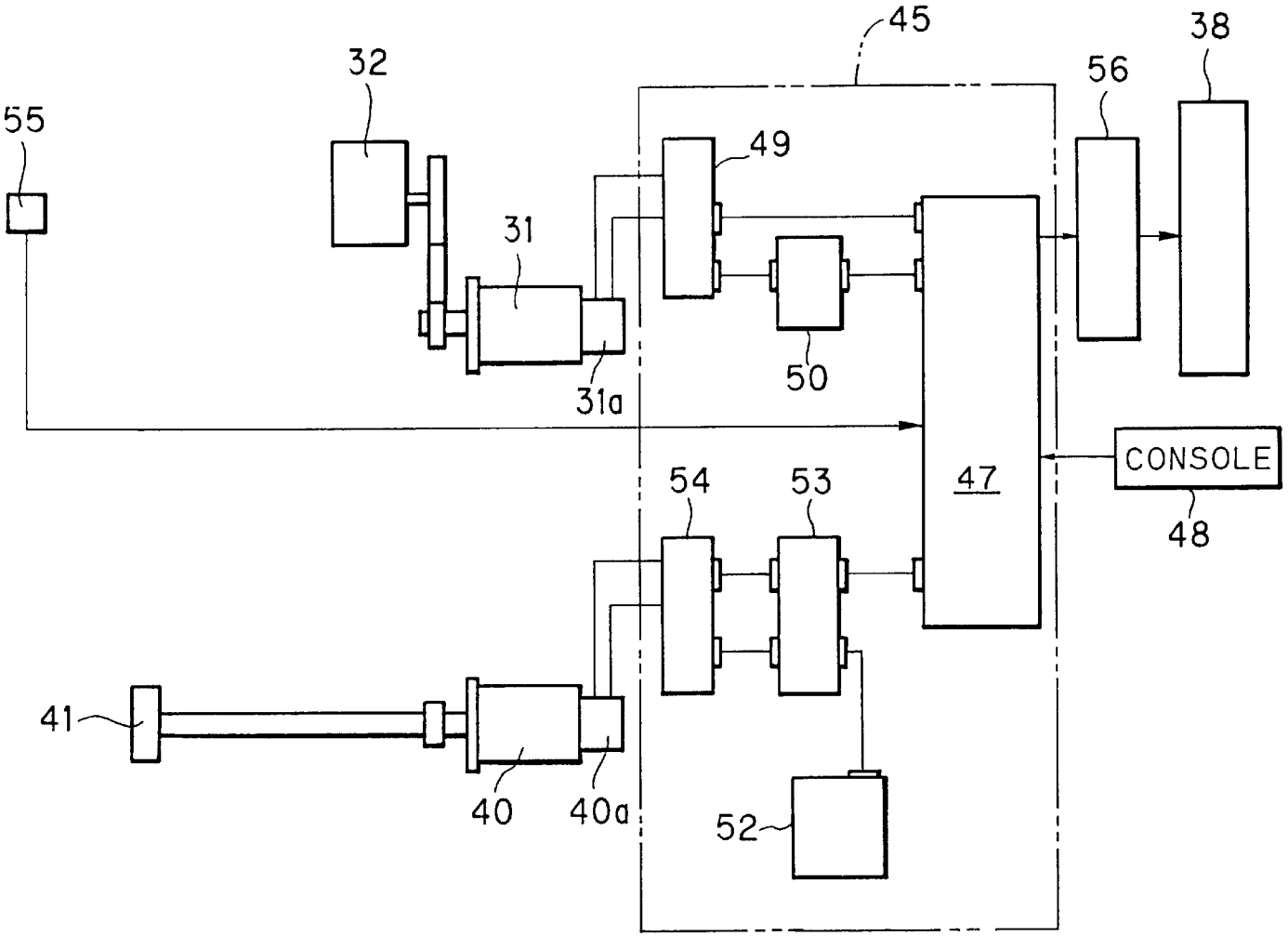
FIG. 5 is a block diagram of a control circuit of the perforator of FIG. 1.

As shown in FIG. 5, the first and second motors 31 and 40 are servo motors having respective encoders 31*a* and 40*a* coupled thereto. The servo motors 31 and 40 are connected to a control unit 45. The control unit 45 includes a main controller 47, a punch drive system and a feed drive system for driving the first and second motors 31 and 40, respectively. The main controller 47 has three drive pattern programs stored therein to control perforating according to one of the three drive pattern programs designated by a command inputted through a console 48.

The punch drive system includes a driver 49 and a speed change circuit 50 for changing the rotational speed of the first motor 31. The speed change circuit 50 outputs a die-punching speed signal to the driver 49 in accordance with a die-punching speed designated by the main controller 47. The driver 49 controls the rotational amount and rotational speed of the first motor 31 in accordance with the die-punching speed signal and a drive signal outputted from the main controller 47.

The feed drive system includes a process controller 52, a positioning controller 53 and a driver 54 for the second motor 40. The process controller 52 has several feed pattern programs, designating transporting speed and transporting time of the measuring feeder 22, stored therein. The positioning controller 53 refers to the process controller 52 to select a suitable one of the feed patterns in accordance with a pattern latch signal from the main controller 47. The positioning controller 53 outputs a signal to the driver 54 in correspondence with the selected feed pattern to designate a transporting speed and a transporting time of the measuring feeder 22. The positioning controller 53 also counts pulses outputted from the encoder 40*a* to detect the rotational amount of the second motor 40. The driver 54 controls the rotational speed and amount of the second motor 40 according to the signals from the positioning controller 53.

The main controller 47 is also connected to a position detector 55 detecting position-of the punch holder 29 in a known manner. Also, the solenoid 38 of the pilot pin mechanism 30 is connected to the main controller 47 through a driver 56.

The operation of the perforator having the construction as set forth above will now be described with respect to a case of manufacturing 36-exposure filmstrips having the new format perforations 14.

Figure 6:
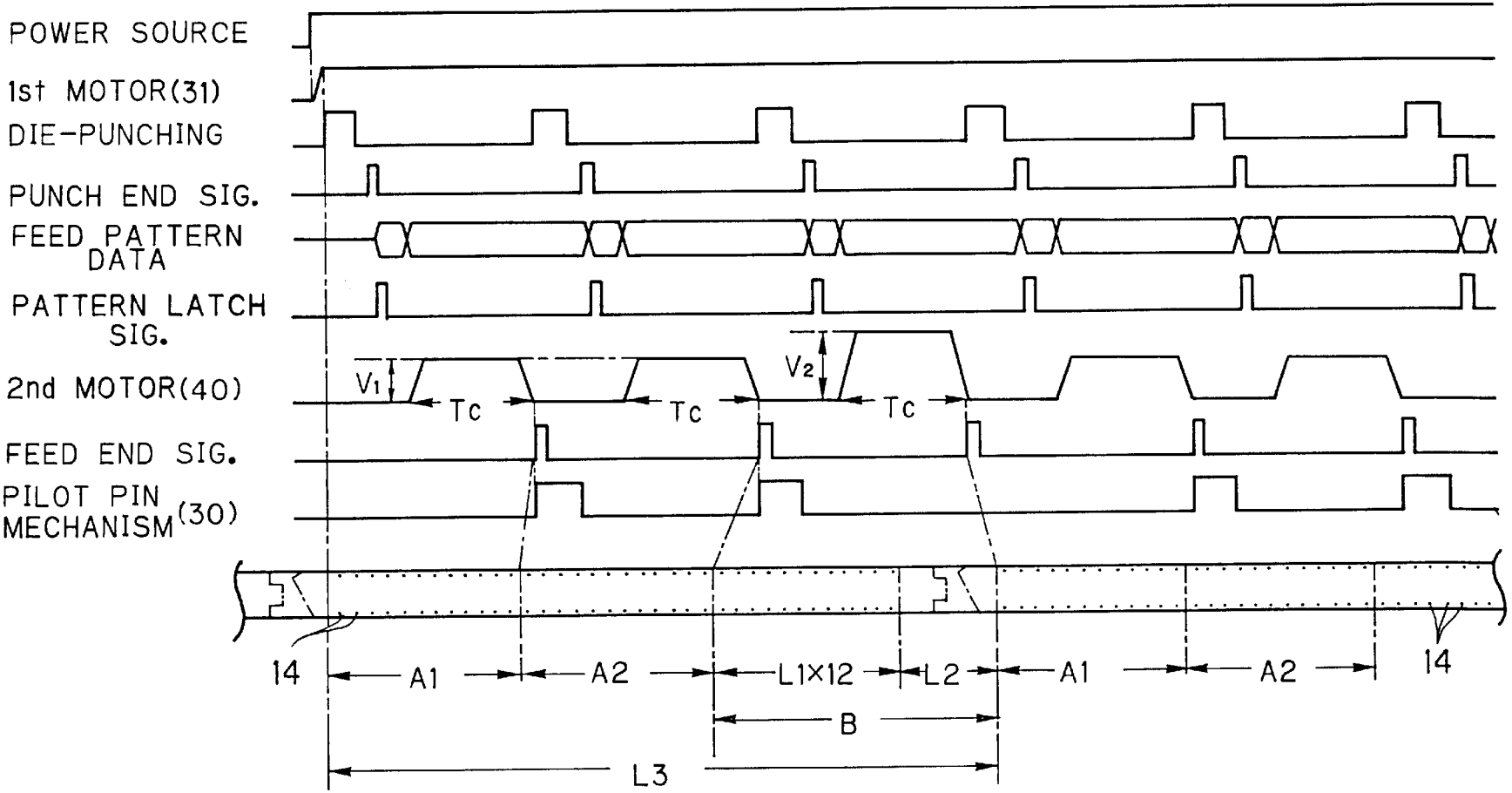
FIG. 6 shows timing charts of a first drive pattern of the perforator of FIG. 1.

According to the first drive pattern program of the three drive pattern programs stored in the main controller 47, the interval of die-punching of the die set unit 21 and the transporting time of the measuring feeder 22 are maintained constant, whereas the transporting speed of the measuring feeder 22 is changed. As shown in FIG. 6, when the first motor 31 is driven at a constant speed, the punch holder 29 is caused to make one stroke through the cam index mechanism 32, thereby executing first die-punching. In result, twelve pairs of perforations 14 are simultaneously formed along the continuous film 11. Then, the position detector 55 outputs a punch end signal to the main controller 47. In response to the punch end signal, the main controller 47 outputs a first pattern latch signal to the positioning controller 53. In response to the first pattern latch signal, the positioning controller 53 refers to the process controller 52 to select an appropriate feed pattern, and controls the driver 54 according to the selected feed pattern to drive the second motor 40 at a designated rotational speed for a designated time. As a result, the continuous film 11 is fed at a transporting speed V1 for a time Tc corresponding to the designated values.

The positioning controller 53 counts the pulses generated by the encoder 40*a* to stop driving the second motor 40 through the driver 54 when the cont of the encoder pulses reaches a value corresponding to a predetermined first transporting amount A1. The first transporting amount Al corresponds to the length L1×12, that is, the length of the portion where the twelve pairs of perforations 14 have just been formed at the first die-punching. Simultaneously with the stopping of the second motor 40, the positioning controller 53 also outputs a feed end signal to the main controller 47. Upon the fed end signal, the main controller 47 controls the solenoid 38 through the driver 56, to move the pilot pins 35 to the engaging position. Because the pilot pins 35 are thus engaged in the last two pairs of the just formed perforations 14, the continuous film 11 is precisely positioned for the next die-punching in relation to the preceding perforations 14.

While the pilot pins 35 are still engaged in the perforations 14, a second die-punching operation is executed by the intermittent movement of the cam index mechanism 32. As a result, twelve pairs of perforations 14 are formed in series with and at the same intervals as the preceding twelve pairs of go perforations 14 along the longitudinal direction of the film 11.

Then, the position detector 55 outputs a punch end signal to the main controller 47. In response to the punch end signal, the main controller 47 controls Is the solenoid 38 through the driver 56 to move the pilot pins 35 into the retracted position. Thereafter, the main controller 47 sends the positioning controller 53 a second pattern latch signal which is same as the first pattern latch signal, so that the positioning controller 53 selects the same feed pattern as above from the process controller 52. As a result, the second motor 40 is driven by the driver 54 to feed the continuous film 11 at the same speed V1 for the same time Tc as the first transporting step. Thereby, the continuous film 11 is farther fed by an amount A2 equal to the first transporting amount A1, that is, by the length L1×12.

Then, the positioning controller 53 outputs a feed end signal to the main controller 47, whereupon the main controller 47 controls the pilot pin mechanism 30 to move the pilot pins 35 into the engaging position. Thereafter, a third die-punching operation is executed by the intermittent movement of the cam index mechanism 32. As a result of the three die-punching operations, 36 pairs of perforations 14 are formed along the longitudinal direction of the continuous film 11 on the lateral sides thereof. In this way, the perforations 14 necessary for a 36-exposure filmstrip are provided.

Figure 26:
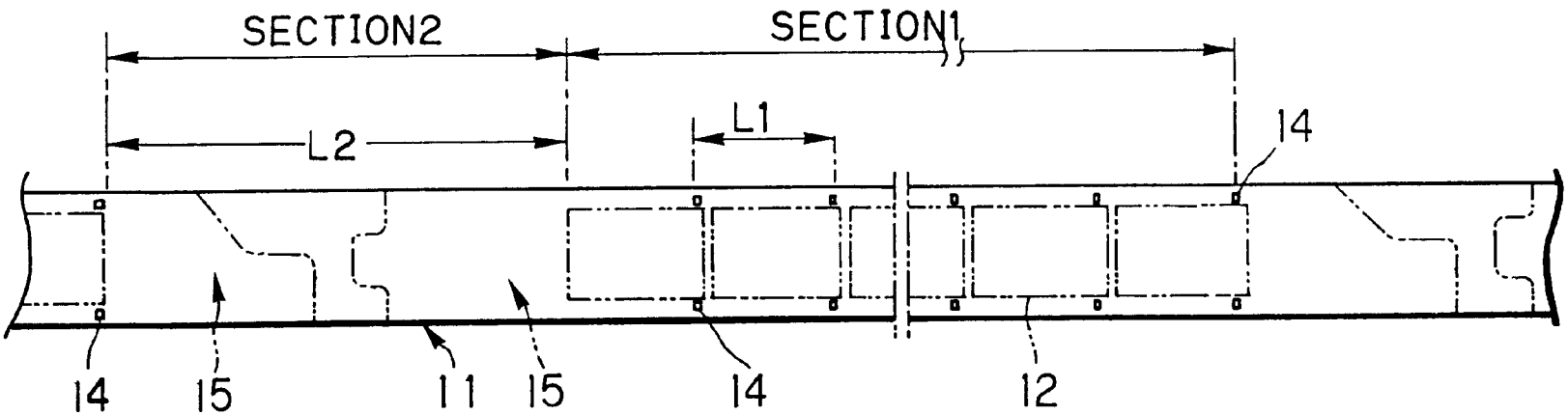
FIG. 26 PRIOR ART
FIG. 26 is an explanatory view of a continuous film in which a pair of perforations are disposed on opposite lateral sides of each frame exposure location.

After controlling the solenoid 38 to reset the pilot pins 35 into the retracted position through the driver 56 in response to a punch end signal from the position detector 55, the main controller 47 applies the positioning controller 53 with a third pattern latch signal which is different from the first and second pattern latch signals. The positioning controller 53 then reads a different feed pattern from the process controller 52 in accordance with the third latch pattern signal, and designates the driver 54 to transport the continuous film 11 at a higher speed V2 than the speed VI for the same time Tc as the first and second transporting steps. Thereby, the continuous film 11 is fed by an amount B which includes the length L1×12 of the portion having twelve pairs of perforations 14 and the length L2 of the section 2 of the film 11, that is, the section where no frame is to be recorded (see FIG. 26). As a result of the first to third transporting steps, the continuous film 11 has been fed by an amount corresponding to the length L3 allocated to one 36-exposure filmstrip.

Figure 7:
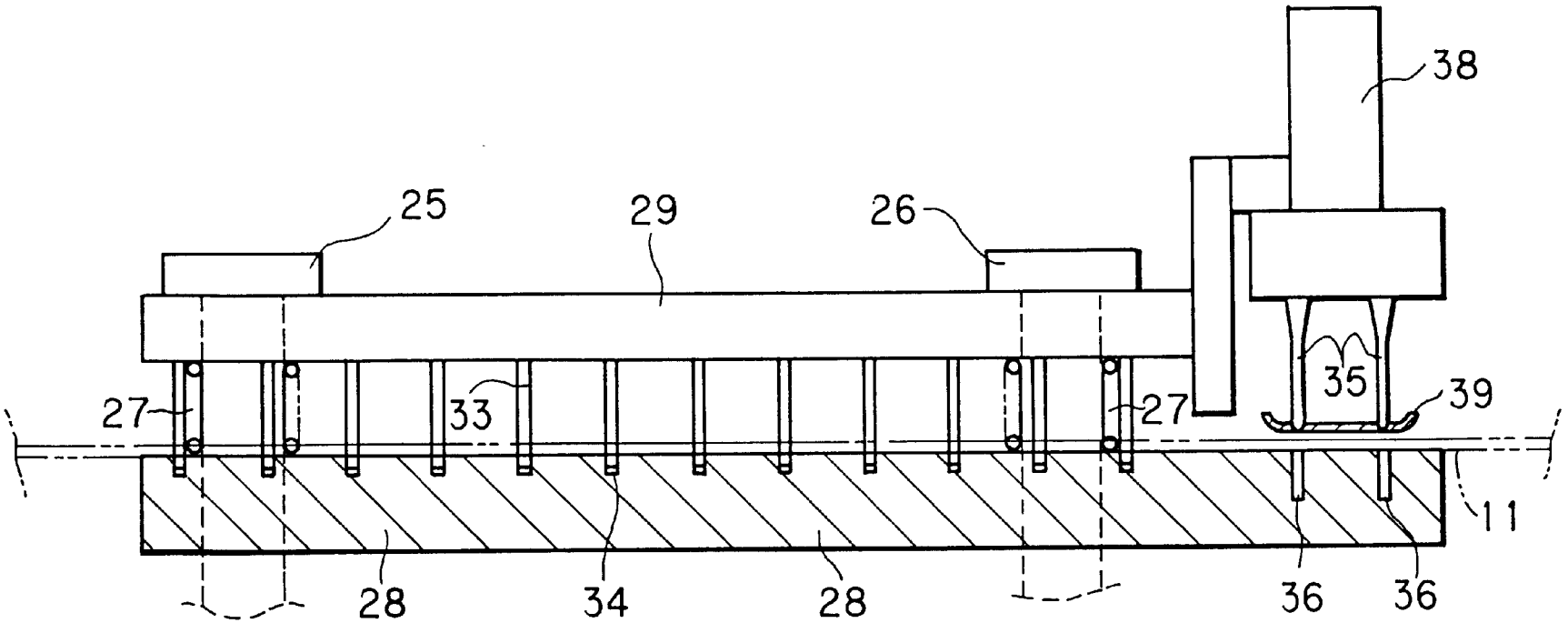
FIG. 7 is a view similar to FIG. 2, but showing the die set unit in a perforating position.

On a fourth die-punching operation, that is, a first die-punching operation for another filmstrip, 1s the main controller 47 controls the solenoid 38 of the pilot pin mechanism 30 so as to maintain the pilot pins 35 in the retraced position. In this condition, the pilot pins 35 do not engage in the recesses 36 when the fourth die-punching is executed, as is shown in FIG. 7. Therefore, the pilot pins 35, which are disposed in opposition to the section 2 in the fourth die-punching, will not damage the section 2.

After forming the first twelve pairs of perforations 14 for the next filmstrip, the same procedures as above are executed so long as the filmstrip to be made is of 36-exposure format. When making perforations 14 of 24-exposure format, the second motor 40 feeds the continuous film 11 at the lower speed V1 in every first transporting step and at the higher speed V2 in every second transporting step, both for the constant transporting time Tc. On the other hand, the pilot pins 35 are set in the engaging position after every first transporting step and are set in the retracted position after every second transporting step. When making perforation 14 of 12-exposure format, the continuous film 11 is always fed at the higher speed V2 for the constant time tc, and the pilot pins 35 are always set in the retracted position.

Figure 8:
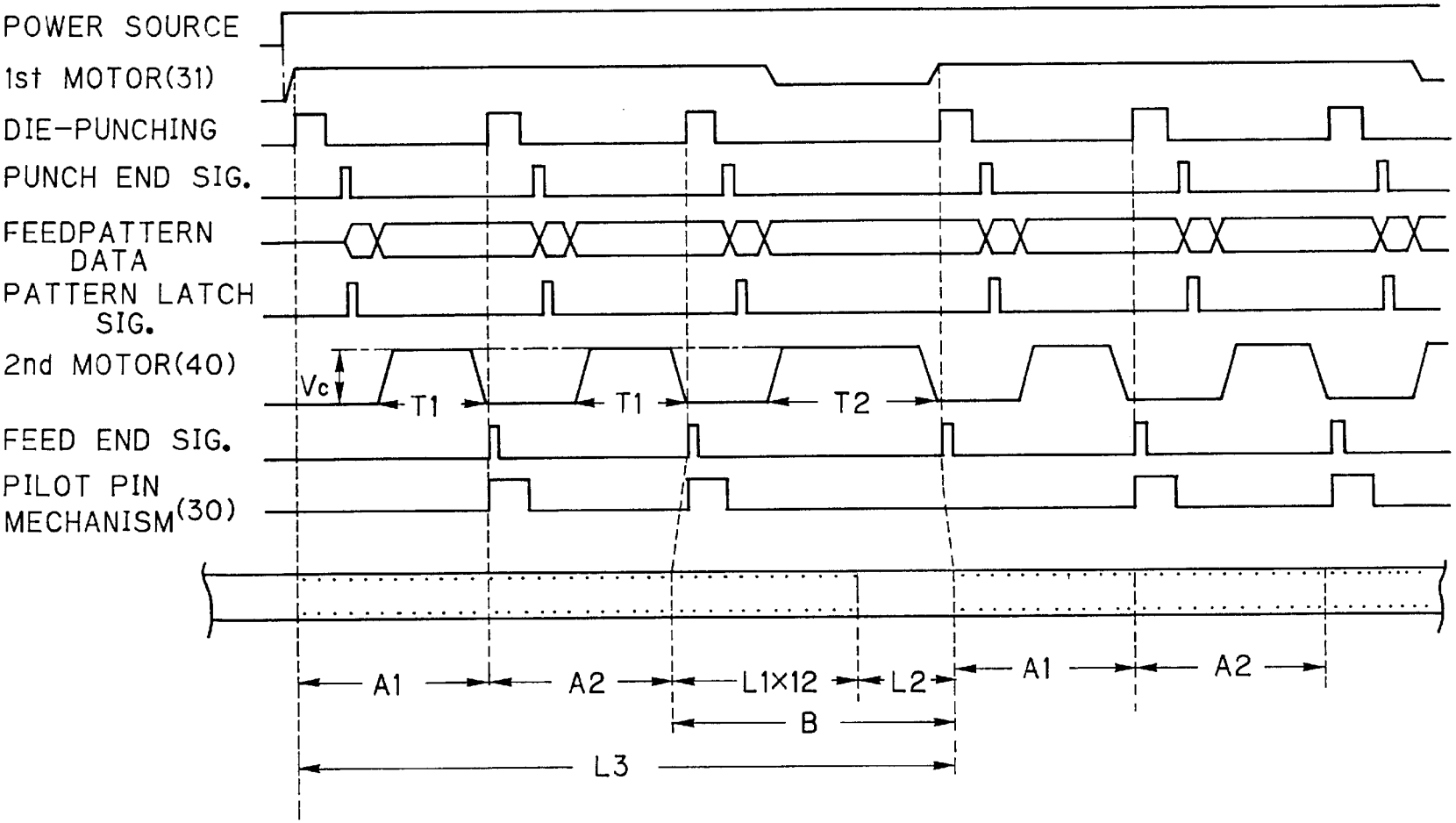
FIG. 8 shows timing charts of a second drive pattern of the perforator of FIG. 1.

According to the second drive pattern program, the transporting speed of the measuring feeder 22 is set at a constant value Vc, while the die-punching interval of the die set unit 21 as well as the transporting time of the measuring feeder 22 are to changed, as is shown in FIG. 8 with respect to the case of making 36-exposure format perforations. In this case, a transporting time T2 necessary for transporting the continuous film 11 by the length B, that is, the length L1×12 of the portion having 15 twelve pairs of perforations 14 plus the length L2, is longer than a transporting time Ti necessary for transporting the continuous film 11 by the length L1×12. Therefore, after the third die-punching operation of one 36-exposure film, the first motor 31 2G for the die-punching is controlled to stop rotating for a given time. It is instead possible to rotate the first motor at a lower speed after the third die-punching than after the first and second die-punching.

Figure 9:
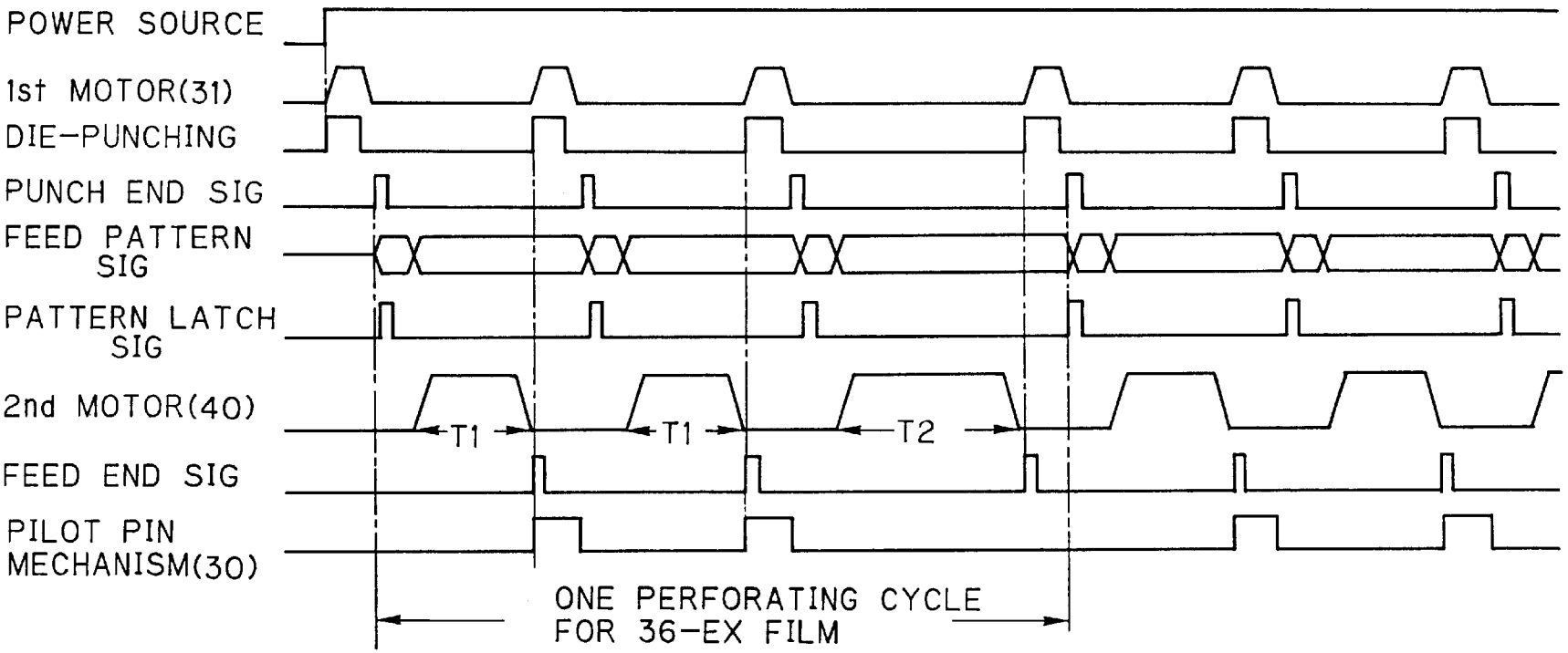
FIG. 9 shows timing charts of a third drive pattern of the perforator of FIG. 1.

According to the third drive pattern program, the first motor 31 is driven merely for the duration of the die-punching stroke, as is shown in FIG. 9. Other procedures are equivalent to the second drive pattern program.

The perforator as set forth above is compact in size, easy to control, and can work at a relatively high speed because only three die-punching strokes are necessary for 36-exposure film.

Although the above-described die set unit 21 has twelve pairs of punches 33 and the corresponding number of dies 34, the present invention should not be limited to this embodiment. For example, it is possible to use a die set unit having two pairs of punches, one pair being spaced at the interval L1 from the other pair in the film transporting direction correspondingly to the interval of the frame exposure locations 12.

Figure 10:
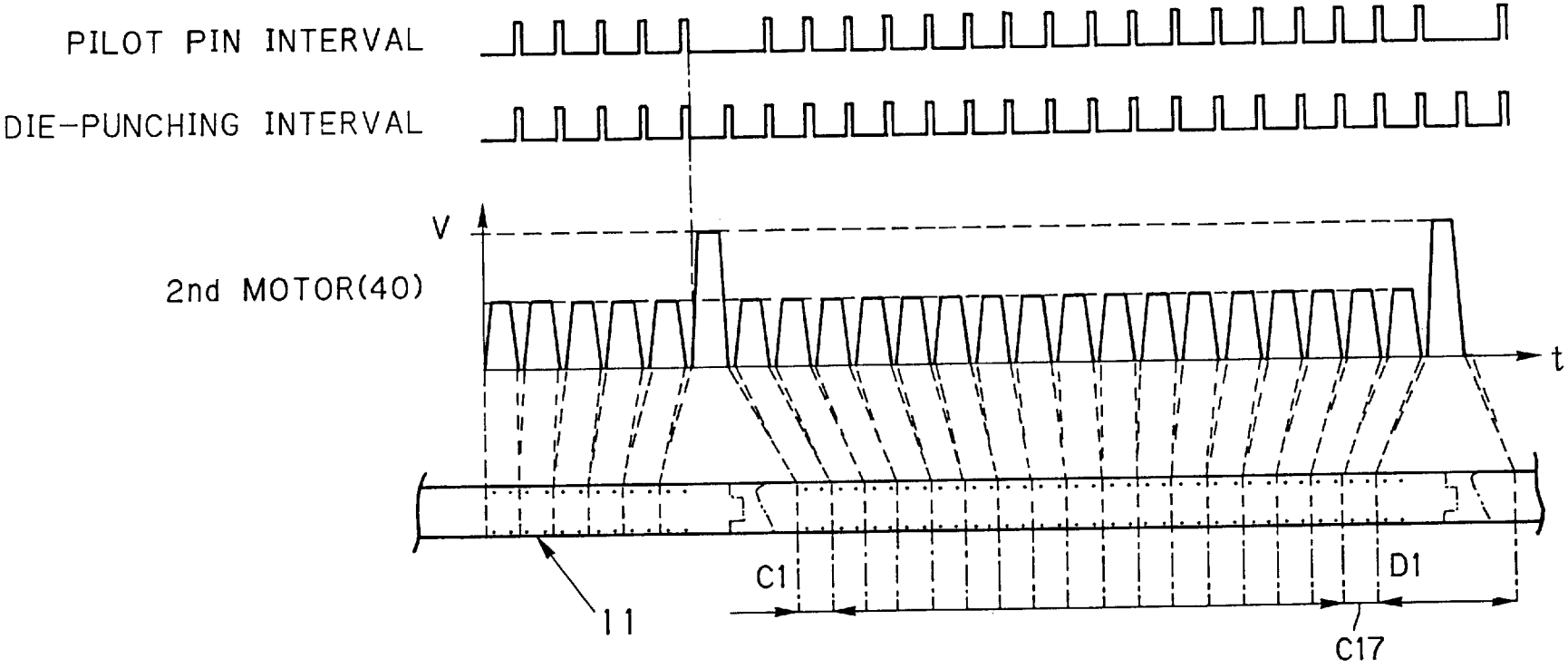
FIG. 10 is an explanatory view showing a first drive pattern of a perforator according to a second embodiment of the invention.
Figure 11:
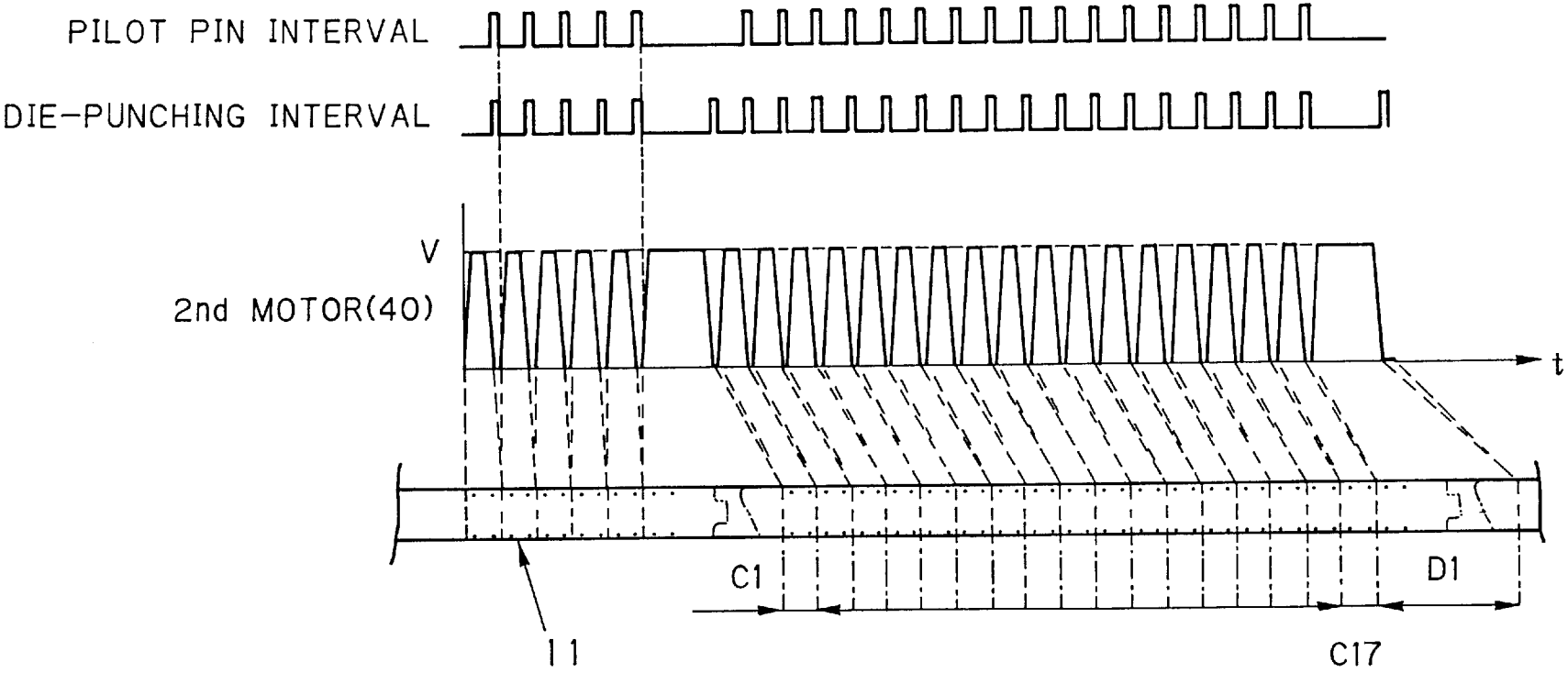
FIG. 11 is an explanatory view showing a second drive pattern of a perforator according to the second embodiment.

When using such a die set unit, according to the first drive pattern where the die-punching interval and the transporting-time of the measuring feeder 22 are maintained constant, but the transporting speed is changed, the die-punching interval and the feed pattern are given as shown in FIG. 10, as for 36-exposure film. If the die set unit having two pair of punches is driven according to the second drive pattern where the die-punching interval and the transporting time are changed while the transporting speed of the measuring feeder 22 is maintained constant, the die-punching interval and the feed pattern are given as shown in FIG. 11. In FIGS. 10 and 11, C1 to C17 indicate respective transporting amounts of the first to seventeenth transporting steps of one perforating cycle for 36-exposure film, and D1 indicates a transporting amount of the eighteenth transporting step. The amounts C1 to C17 are constant and correspond to the length L1×2, while the amount D1 corresponds the length L1×2+L2. According to this embodiment, a very compact perforator is achieved.

Figure 12:
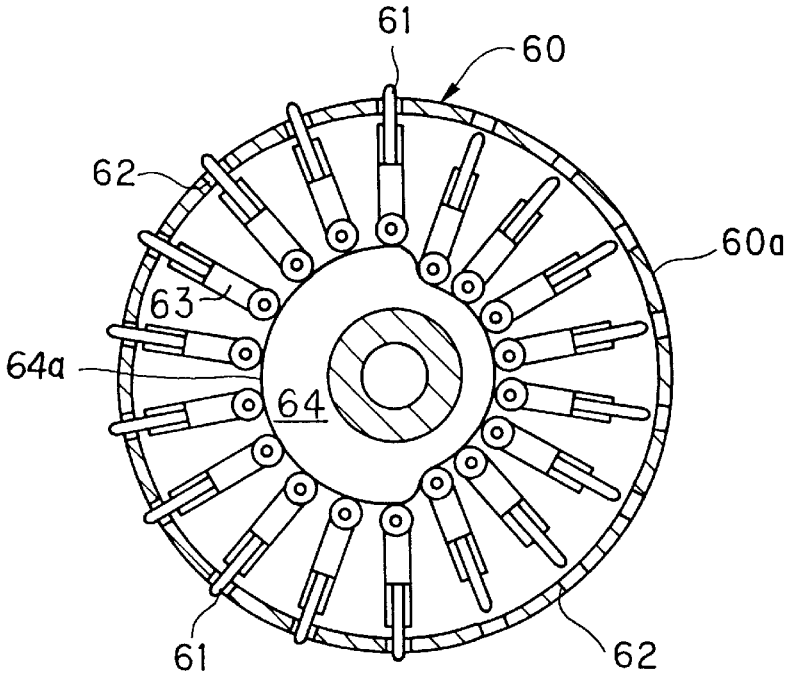
FIG. 12 is a radial section of a modified measuring feeder.
Figure 13:
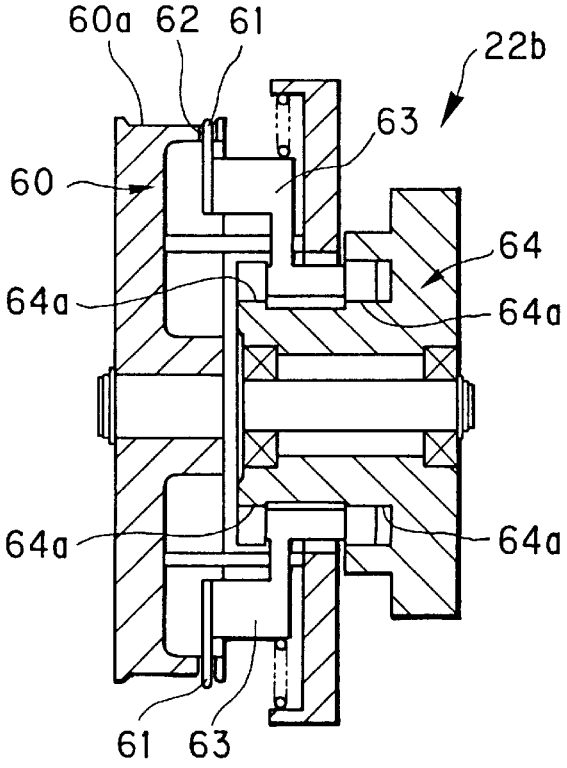
FIG. 13 is an axial section of the measuring feeder shown in FIG. 12.

FIGS. 12 and 13 show another embodiment of the measuring feeder 22, wherein a feed roller 60, which is driven to rotate by the second motor 40, has a film convey surface 60*a* formed on the peripheral surface thereof. A plurality of sprocket 61 are mounted inside the feed roller 60 and are arranged radially at regular intervals. Holes 62 for allowing the tips of the sprockets 61 to radially protrude to the outside of the feed roller 60 are formed through the film convey surface 60*a* in correspondence with the sprockets 61. The spacing of the holes 62 corresponds to the length L1, that is, the spacing of the perforations 14. The sprockets 61 are each secured to a cam follower 63 having a crank shape. The cam followers 63 contact an annular cam surface 64*a* formed around the outer periphery of a cam roller 64. The cam surface 64*a* has such a shape that the sprockets 61 are caused to protrude from and then retract into the film convey surface 60*a* through the holes 62 when the cam roller 64 is rotated.

Because the cam roller 64 is rotated in synchronism with the alternating transport intervals of the section 1 and the section 2 of the film 11, the sprockets 61 protrude from the film convey surface 60*a* when the section 1 of the continuous film 11 is brought into contact with the surface with the surface 60*a*, and engage in the perforations 14. When the section 2 is transported on the feed roller 60, the sprockets 61 is retracted. The peripheral speed of the cam roller 64 can be controlled independently of the peripheral speed of the feed roller 60. Therefore, the measuring feeder of this embodiment can meet any type film 15 having new format perforations 14 of various frame number, such as 36-exposure film, 24-exposure film and so forth.

Figure 14:
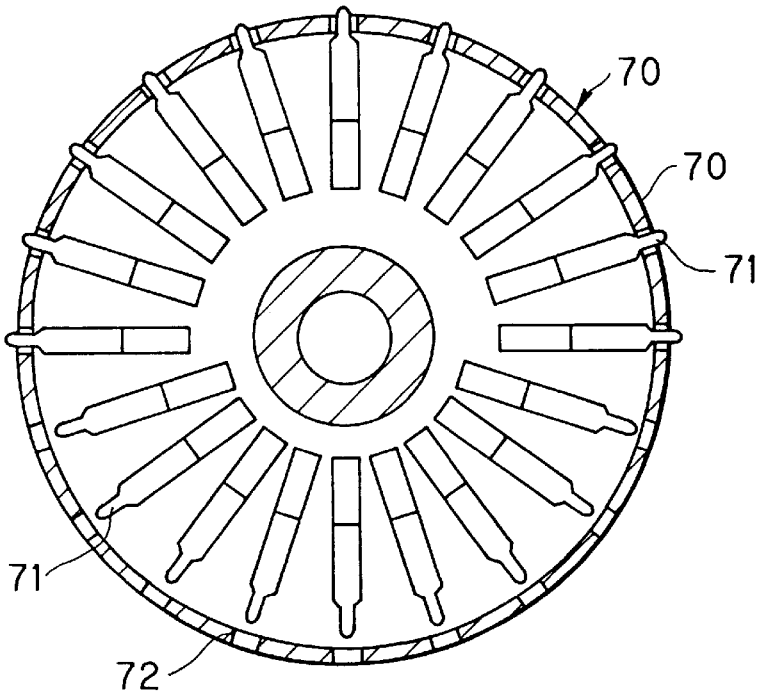
FIG. 14 is a radial section of another modified measuring feeder.
Figure 15:
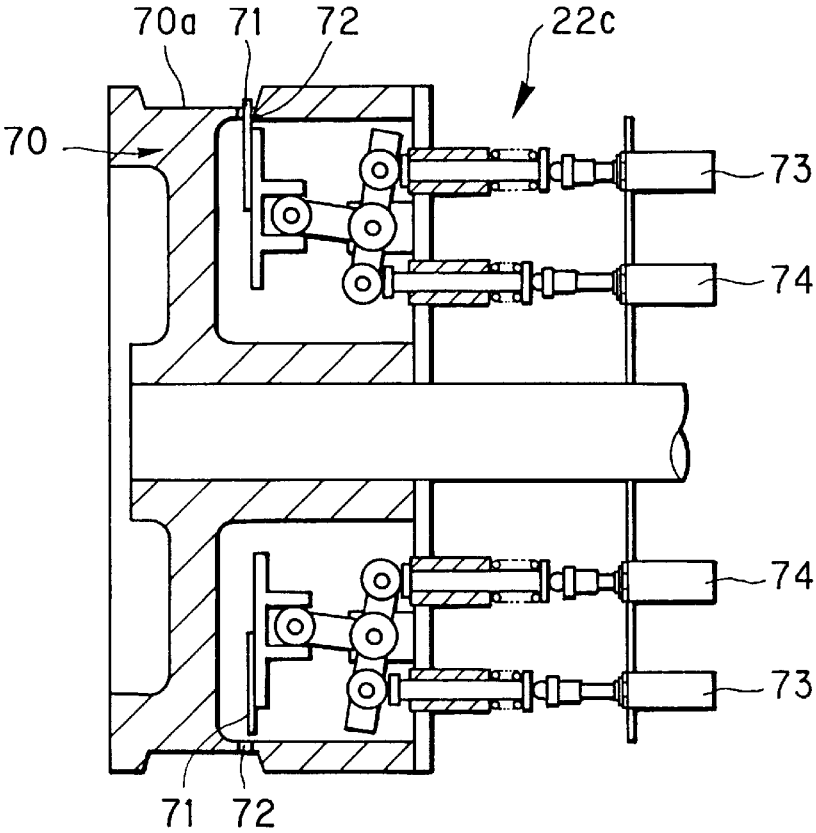
FIG. 15 is an axial section of the measuring feeder shown in FIG. 14.

FIGS. 14 and 15 show another sprocket type measuring feeder 22, wherein a feed roller 70 has a plurality of holes 72 formed through a peripheral surface 70*a* thereof which forms the film convey surface. A plurality of sprockets 71 are radially arranged in the feed roller 70. Each sprocket 71 is driven by a pair of solenoids 73 and 74 to radially protrude from and retract into the film convey surface 70*a* through the hole 72 by means of a pair of solenoids 73 and 74. That is, the sprocket 71 is projected when the solenoid 74 is turned on, and is retracted when the solenoid 73 is turned on.

According to this embodiment, the sprockets 71 can be moved at an appropriate timing independently from one another.

Figure 16:
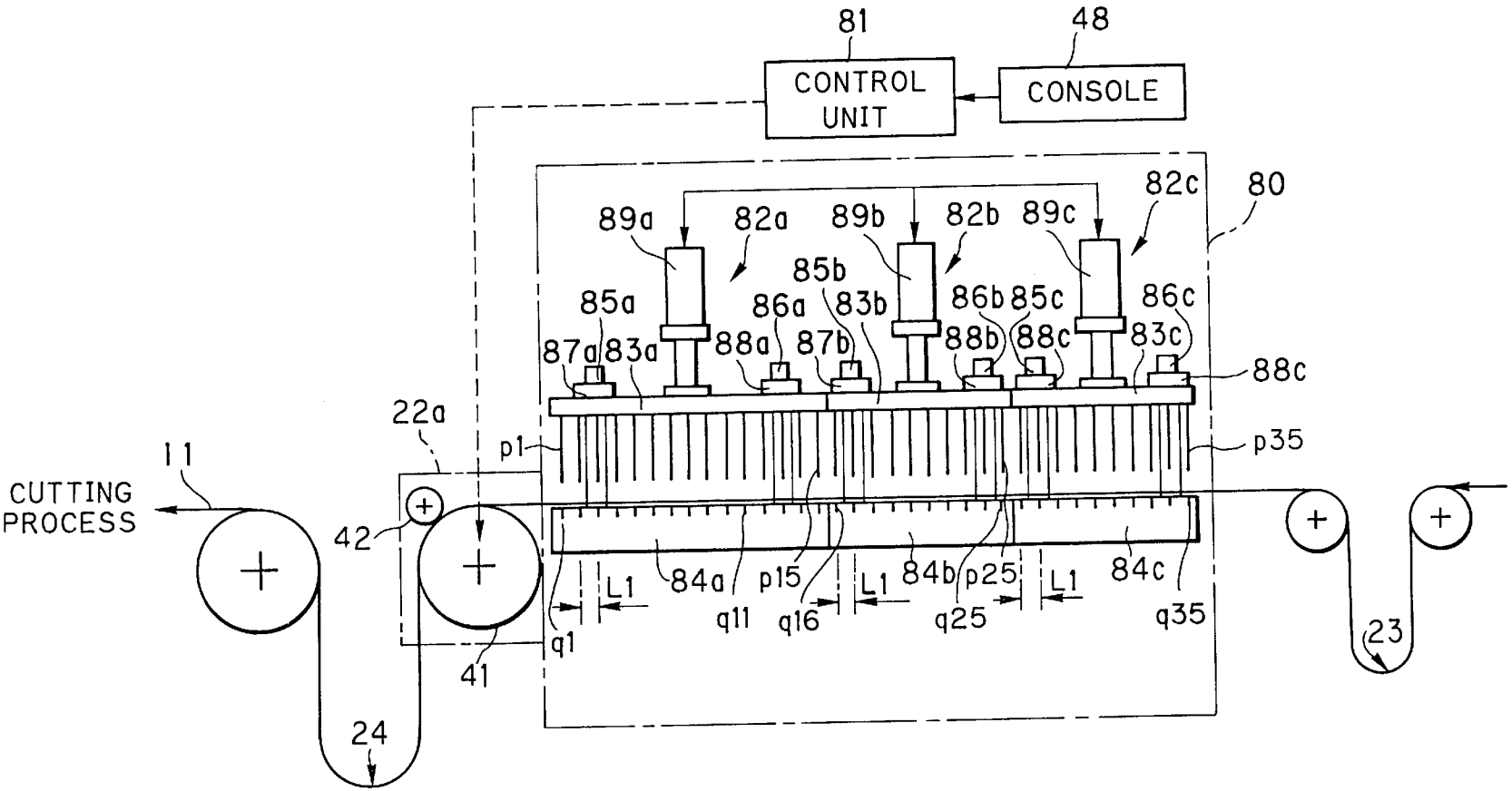
FIG. 16 schematically shows a perforator according to a third embodiment of the invention.

FIG. 16 shows a perforator according to another embodiment of present invention. According to this embodiment, a die set unit has a plurality of die sets, and the number n of die sets included in the die set unit is determined equal to number m of variation of frame number format of the films to be dealt with by the die set unit. Assuming that Fi (i+1, 2 . . . m) represents the frame number of the ith variation in the order from a small to larger number, and Gi (i=1, 2 . . . n) represent the number of punches arranged in a line in the film transporting direction in the ith die set, the number Gi is determined according to the following equation:

$$Gi=Fi-F(i-1).$$

For example, if the number m of frame number variation is three, and if the respective frame numbers F1, F2 and F3 are 15, 25 and 35, the number G1, G2 and G3 of punches of the three die sets are determined as 15, 10 and 10, according to the above definition, because G1=F1−F0=15−0,G2=F2−F1=25−15, and G3=F3−F2=35−25.

Figure 17:
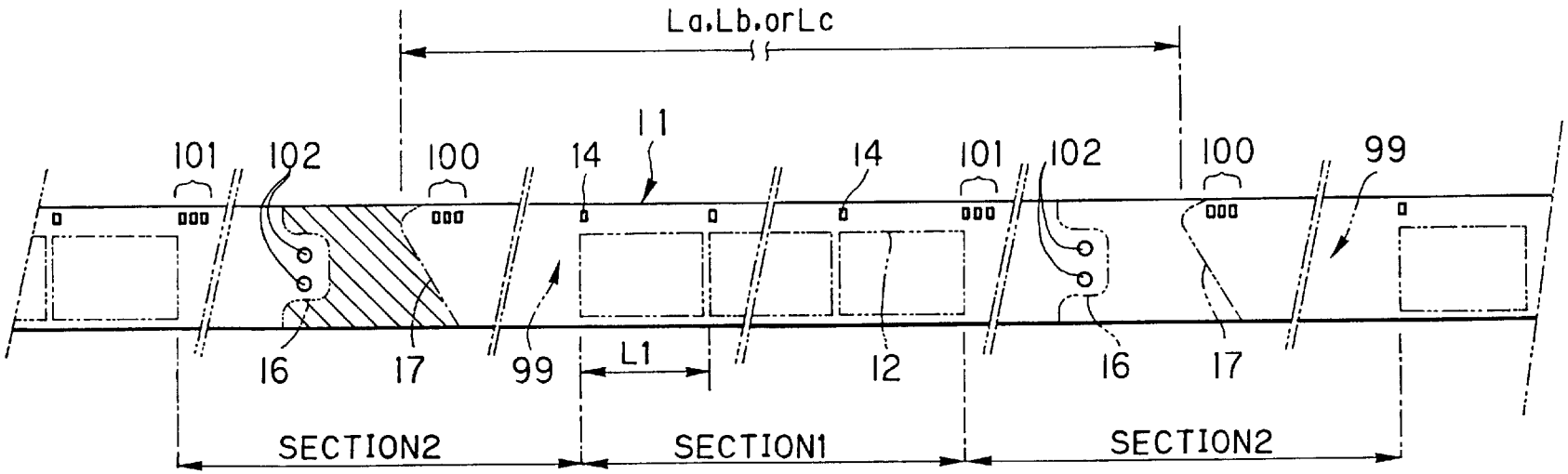
FIG. 17 is an explanatory view of a continuous film in which a perforation is disposed on one lateral side of each frame exposure location.
Figure 18:
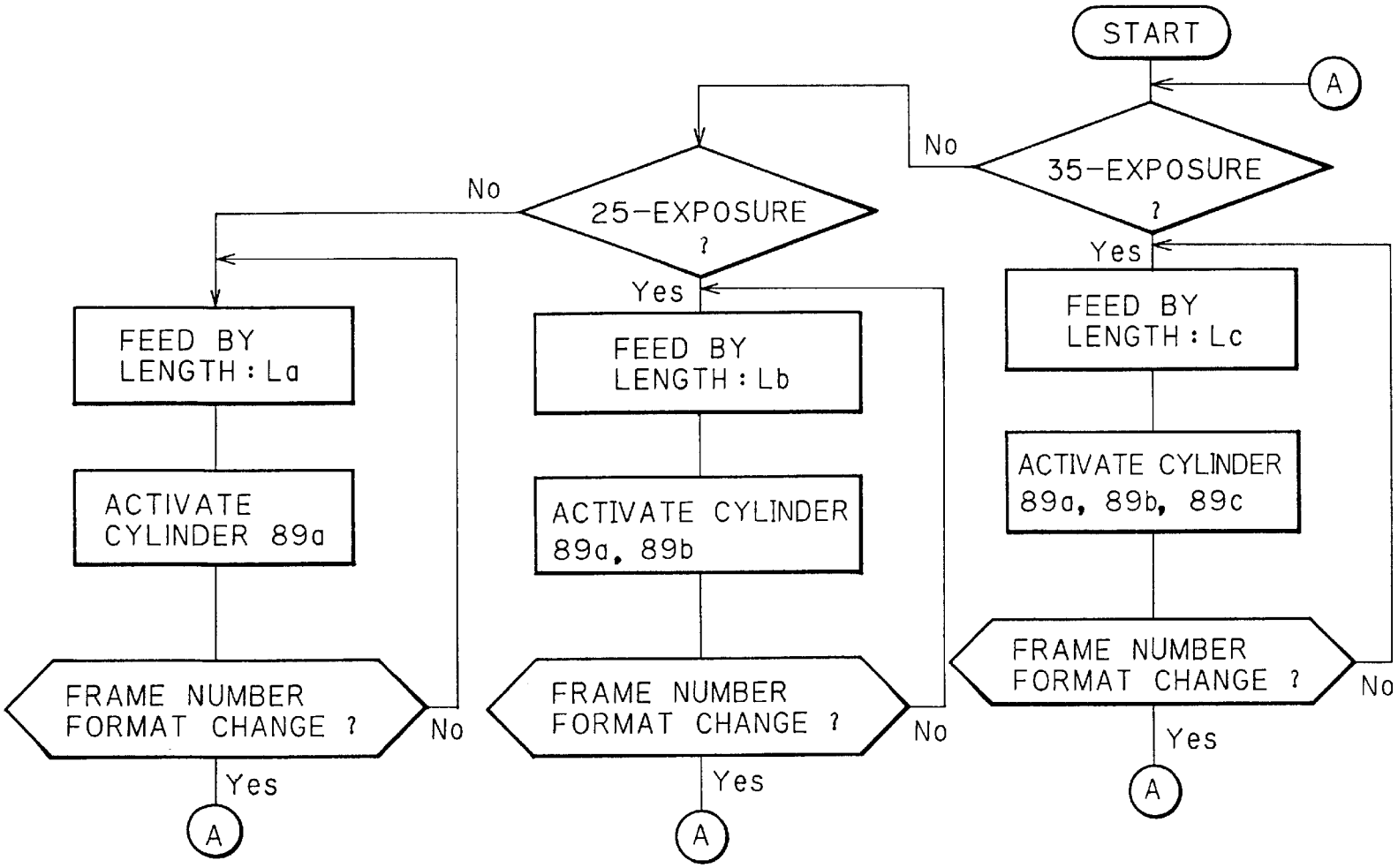
FIG. 18 is a flow chart illustrating the operation of the perforator of FIG. 16.

In FIG. 16, die set unit 80 which is directed to make new format perforations of 15-, 25- and 35-exposure films in a fashion as shown in FIG. 17. That is, a perforation 14 for frame positioning is formed on one lateral side of each frame exposure location 12 at the same interval as the frame interval L1 in the longitudinal direction of the continuous film 11. Therefore, the perforations 14 are formed merely within effective recording sections 1 whose length is predetermined for each frame number format. The die set unit 80 and a measuring feeder 22*a* are controlled by a control unit 81 in accordance with data inputted through a console 48. Loop chambers 23 and 24 are disposed before and after the die set unit 80.

The die set unit 80 includes first, second and third die sets 82*a*, 82*b* and 82*c* disposed side by side in this order from the downstream side of the film transporting direction shown by the arrow. The first die set 82*a* is constituted of a punch holder 83*a*, a die holder 84*a*, a pair of guide pins 85*a* and 86*a* secured to the die holder 84*a*, and a pair of bushes 87*a* and 88*a* formed through the punch holder 83*a*. The punch holder 83*a* has fifteen punches p1 to p15 spaced at the interval L1 in the film transporting direction. The die holder 84*a* has fifteen dies q1 to q15 arranged correspondingly to the punches p1 to p15. The guide pins 85*a* and 86*a* are fitted in the bushes 87*a* and 88*a* to guide the punch holder 83*a* to vertically move between a retracted position and a punching position relative to the die holder 84*a* to die-punch the continuous film 11 longitudinally transported through the die set unit 80. The punch holder 83*a* is driven to make the vertical motion or stroke, by a pneumatic or hydraulic cylinder 89*a* coupled to the punch holder 83*a*.

The second die set 82*b* is constituted of a punch holder 83*b*, a die holder 84*b*, a pair of guide pins 85*b* and 86*b* secured to the die holder 84*b*, a pair of bushes 87*b* and 88*b* formed through the punch holder 83*b*, and a second cylinder 89*b* coupled to the punch holder 83*b*. The punch holder 83*b* has ten punches p16 to p25 spaced apart at the interval L1 in the film transporting direction. The die holder 84*b* has ten dies q16 to q25 arranged correspondingly to the punches p16 to p25. The third die set 82*c* is constituted of a punch holder 83*c*, a die holder 84*c*, a pair of guide pins 85*c* and 86*c* secured to the die holder 84*c*, a pair of bushes 87*c* and 88*c* formed through the punch holder 83*c*, and a third cylinder 89*c* coupled to the punch holder 83*c*. The punch holder 83*c* has ten punches p26 to p35 spaced at the interval L1 in the film transporting direction. The die holder 84*c* has ten dies q26 to q35 arranged correspondingly to the punches q26 to q35. The second and third die sets 82*b* and 82*c* operate similarly to the first die set 82*b*. The spacing between the three die sets 82*a*, 82*b* and 82*c* is determined such that all the punches p1 to p35 as well as the dies q1 to q35 are respectively spaced at the constant interval L1 from one another.

Figure 4:
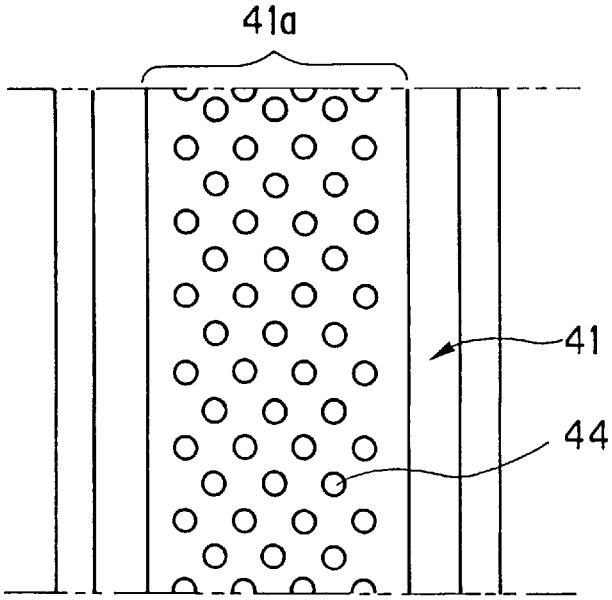
FIG. 4 is an explanatory view of a film convey surface of the measuring feeder shown in FIG. 3.

The measuring feeder 22*a* has the construction as shown in FIGS. 3 and 4. However, the measuring feeder may have the construction as shown in FIGS. 12 and 13 or in FIGS. 14 and 15.

Figure 19:
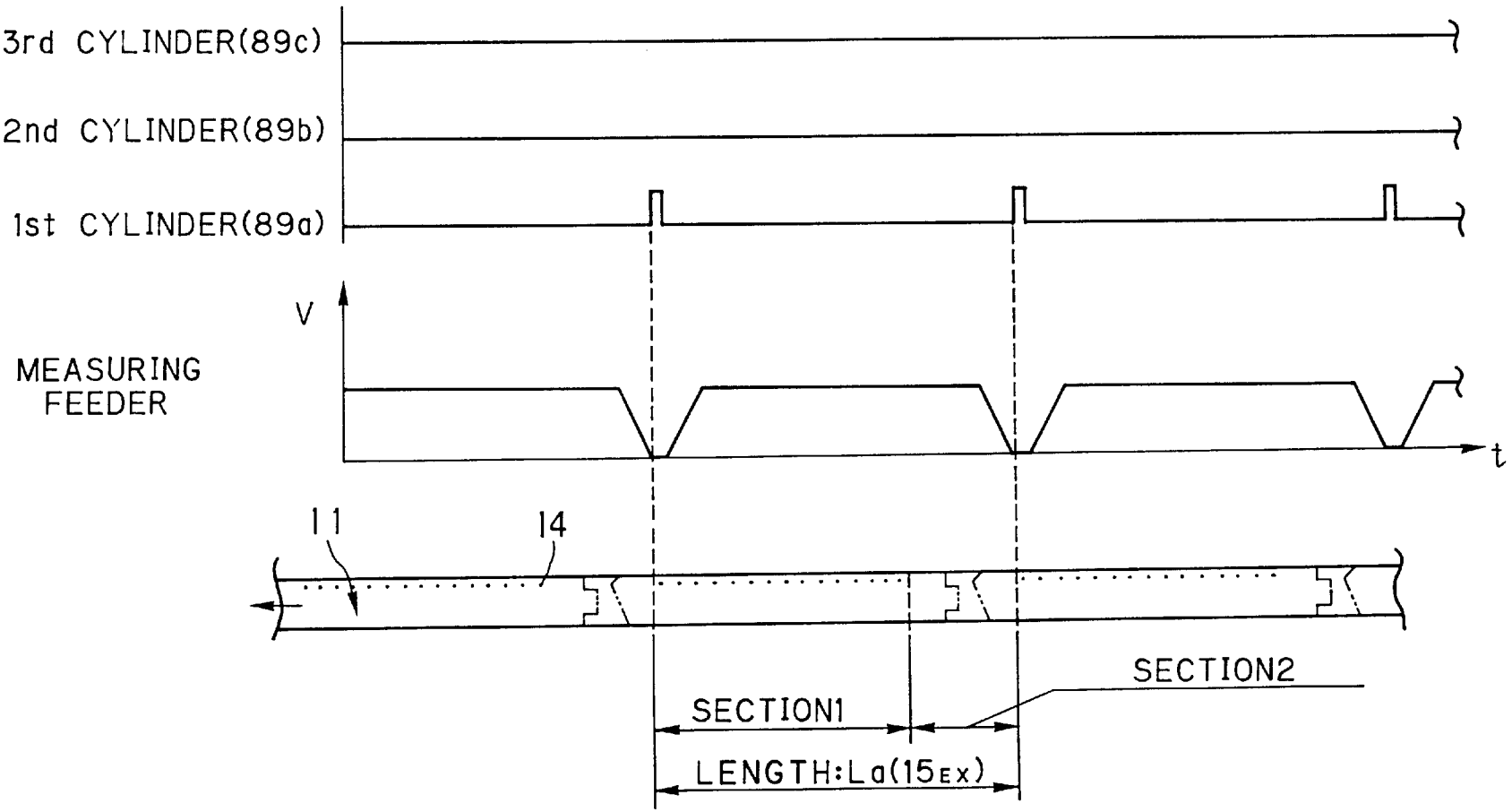
FIG. 19 shows timing charts of the perforator of FIG. 16 for 15-exposure filmstrip.

The operation of the perforator shown in FIG. 16 will be described with reference to FIGS. 18 to 21. When the operator operates the console 48 to designate the frame number of the filmstrip to be made as 15-exposure format, the control unit 81 controls the measuring feeder 22*a* to transport the continuous film 11 by a length La which corresponds to the length of an individual 15-exposure filmstrip, as shown in FIG. 19. Thereafter, only the first cylinder 89*a* is driven to cause the first die set 82*a* to perform die-punching. As a result, fifteen perforations 14 are formed at the spacings L1 in the effective recording section 1 for the 15-exposure filmstrip. The same operation is repeated as long as the 15-exposure format is designated.

Figure 20:
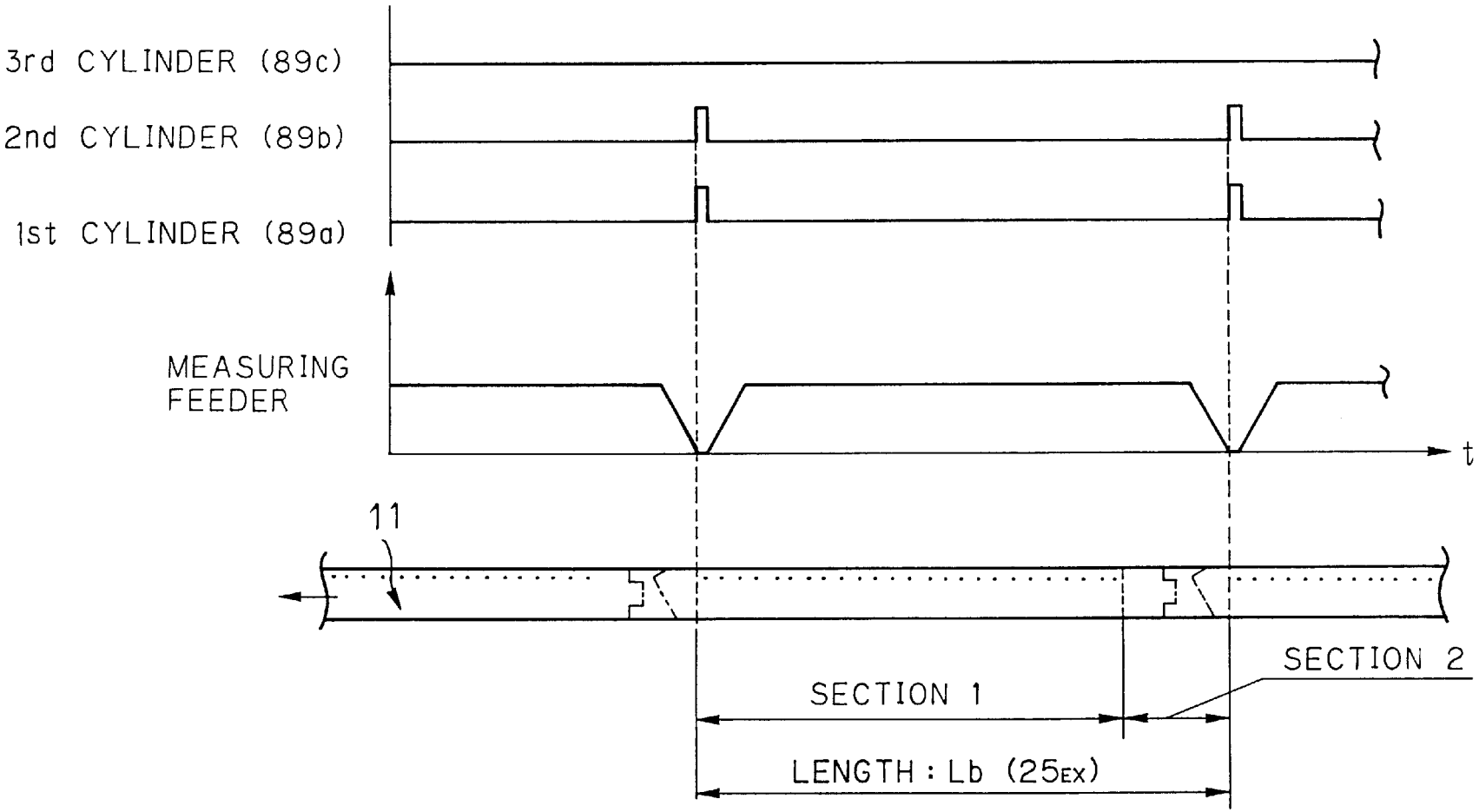
FIG. 20 shows timing charts of the perforator of FIG. 16 for 25-exposure filmstrip.

When a 25-exposure format is designated, the control unit 81 controls the measuring feeder 22*a* to transport the continuous film 11 by a length Lb which is allocated to an individual 25-exposure filmstrip, as is shown in FIG. 20. Thereafter, the first and second cylinders 89*a* and 89*b* are simultaneously driven to cause the first and second die sets 82*a* and 82*b* to perform die-punching. As a result, twenty-five perforations 14 are formed at the spacings L1 in the effective recording section 1 for the 25-exposure filmstrip.

Figure 21:
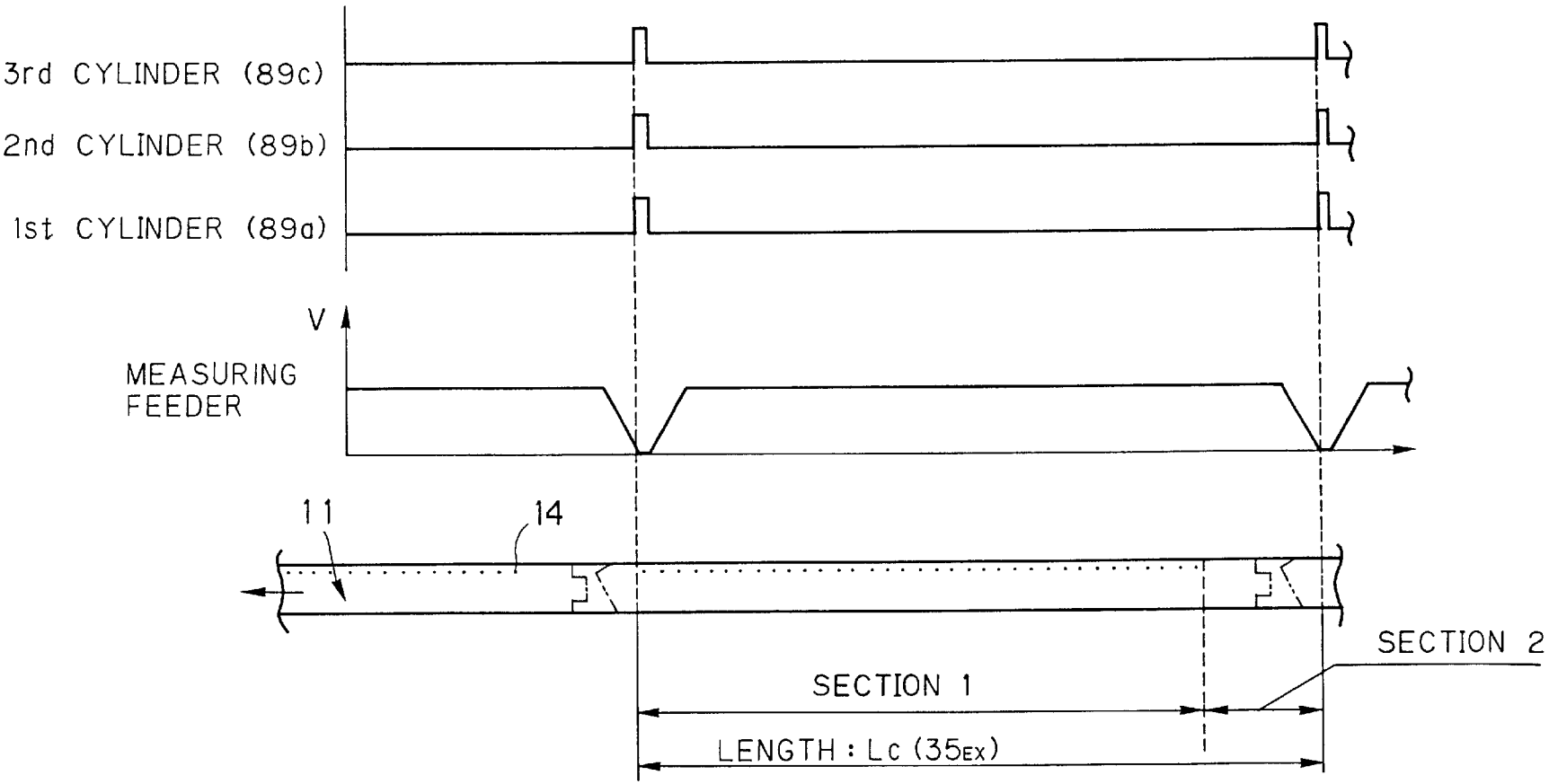
FIG. 21 shows timing charts of the perforator of FIG. 16 for 35-exposure filmstrip.

When a 35-exposure format is designated, the control unit 81 controls the measuring feeder 22*a* to transport the continuous film 11 by a length Lc which is allocated to an individual 35-exposure filmstrip, as is shown in FIG. 21. Thereafter, the first to third cylinders 89*a* to 89*c* are simultaneously driven to cause the first to second die sets 82*a* to 82*c* to perform a die-punching operation. In result, thirty-five perforations 14 are formed at the spacings L1 in the effective recording section 1 for the 35-exposure filmstrip.

Although the transporting time is changed to change the transport amount of the continuous film 11 in accordance with the designated frame number in the embodiment shown in FIGS. 19 to 21, it is instead possible to change the transporting speed of the film 11. Thereby, the die-punching interval for the film of a larger frame number format can be shortened compared with the case of changing transporting time.

Furthermore, the number of die sets is not necessarily equal to the number of frame number variation of the films to be dealt with by a common perforator. For example, if the last two or more of the die sets would have the same number of punch-and-die pairs according to the above-described definition, these die sets may be substituted by a single die set having that number of punch-and-die pairs. In this case, the last die set may be driven more than one time in one perforating cycle for an individual filmstrip depending upon the number of frame exposure locations to be provided.

For example, as to the case described with reference to FIGS. 16 to 21, since the second and third die sets 82*b* and 82*c* have ten pairs of punches and dies, it is possible to omit the third die set 82*c*. When making perforations 14 for 35-exposure format film, according to this embodiment, the first and second cylinders 89*a* and 89*b* are simultaneously driven to form twenty-five perforations 14.

Thereafter, the measuring feeder 22*a* transports the continuous film 11 by a length corresponding to ten frame exposure locations L1×10. Then, only the second cylinder 89*b* is driven to cause the second die set 82*b* to perform die-punching. Thus, thirty-five perforations 14 are formed at the same spacing L1 within the effective recording section 1. This embodiment is preferable for reducing the number of die sets of the die set unit, improving compactness, and lowering the cost of the perforator.

On the other hand, if the number of punches and dies of a die set would become so large that the precision of that die set might be lowered, it is possible to divide the die set into segments having less punches and dies. In this case, guide pins and other necessary elements are provided for each die set segment equivalently to the above-described die sets 82*a* to 82*c*.

Although the first to third punch holders 83*a* to 83*c* are drive individually by the first to third cylinders 89*a* to 89*c*, it is also possible to selectively drive a plurality of punch holders by a single cylinder in combination with cam members provided for the respective punch holders.

Figure 22:
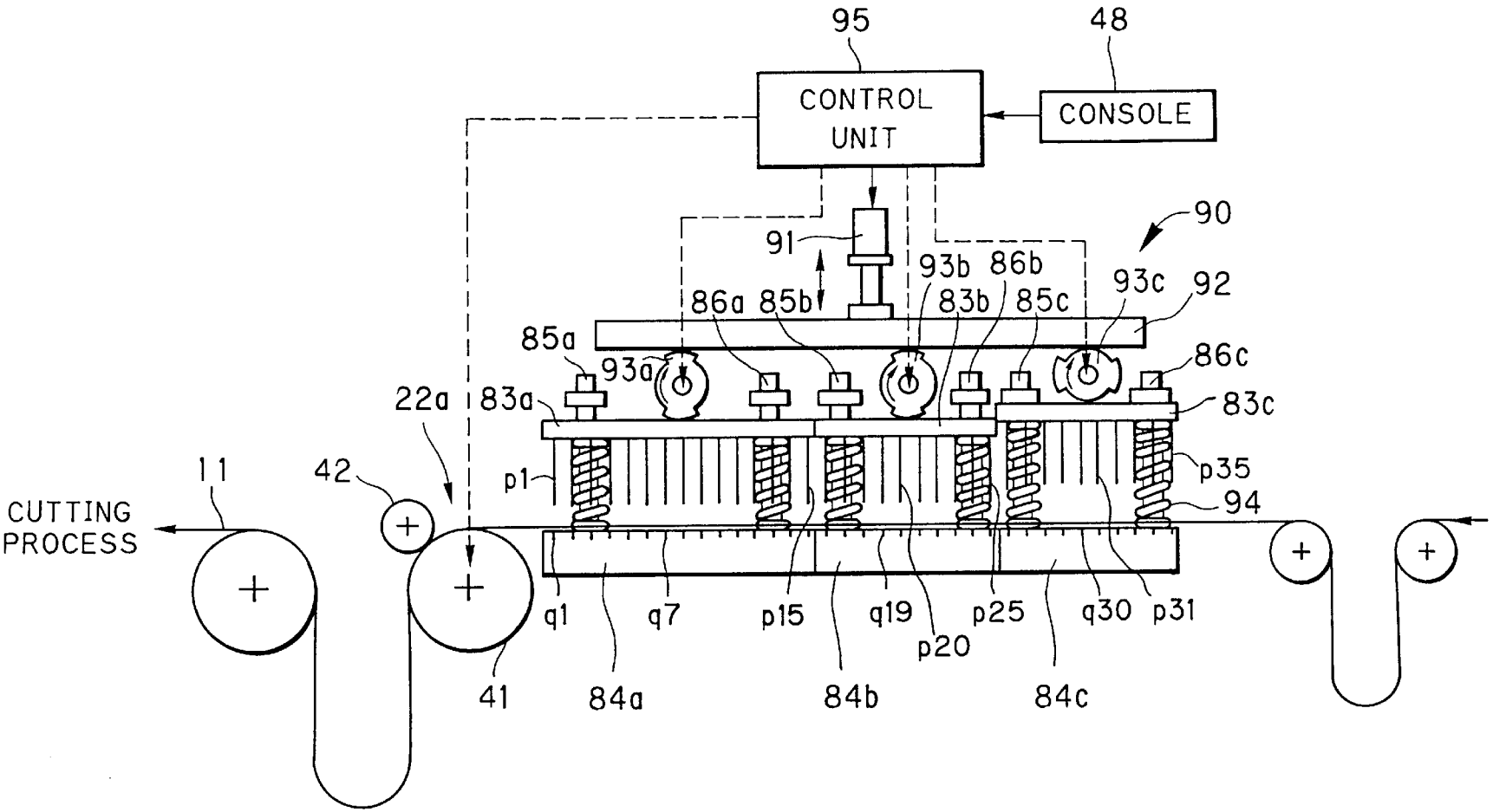
FIG. 22 schematically shows a perforator according to a fourth embodiment of the invention.

A die set unit 90 shown in FIG. 22 shows such an embodiment.

In the die set unit 90, a cylinder 91 is coupled to a ram 92, which is coupled to three punch holders 83*a*, 83*c* and 83*c* through respective cams 93*a*, 93*b* and 93*c*. The cams 93*a* to 93*c* are vertically movable along with the ram 92. Because the cams 93*a* , 93*b* and 93*c* are rotatable between an active position as shown by the first and second cams 93*a* and 93*b*, on one hand, and an inactive position as shown by the third cam 93*c*, on the other hand. The punch holders 83*a* to 83*c* are urged toward the cams 93*a* to 93*c* under the force of springs 94 mounted on respective pairs of guide pins 85*a*, 86*a*; 85*b*, 86*b*; and 85*c*, 86*c* secured to corresponding die holders 84*a*, 84*b* and 84*c*. Therefore, the punch holders 83*a* to 83*c* are vertically moved along with the cams 93*a* to 93*c*, respectively. Other constructions of the die set 90 are similar to the die set 80 shown in FIG. 16.

A controller 95 selectively sets the cams 93*a* to 93*c* in the active or the inactive position in accordance with the frame number designated through a console 48. If the punch holder 83*a*, 83*b* or 83*c* should not be activated, the associated cam 93*a*, 93*b* or 93*c* is set in the inactive position. In the inactive position of the cam 93*a*, 93*b* and 93*c*, the distance from the punch holder 83*a*, 83*b* or 83*c* to the opposed die holder 84*a*, 84*b* or 84*c* becomes more than that in the active position. Therefore, in the die set whose cam is set in the inactive position, punches are not engaged in dies when the cylinder 91 is driven to move the ram 92 in a downward direction. In the case shown in FIG. 22, for instance, the punches pi to p15 and p16 to p25 of the first and second punch holders 83*a* and 83*b* are engaged in the dies q1 to q15 and q15 to q16 to q25 of the first and second die holders 84*a* and 84*b*, whereas the punches p26 to p35 are not engaged in the dies q26 to q35 of the third die holder 84*c*.

The rotational movement of the cams 93*a* to 93*c* may be controlled by motors, clutches or brakes in a known manner. The cams; 93*a* to 93*c* may be replaced by spacer blocks, cylinders or the like. The cylinder 91 may be replaced by a rotary cam, a crank, or the like which causes the ram 92 to move in a vertical direction.

Figure 23:
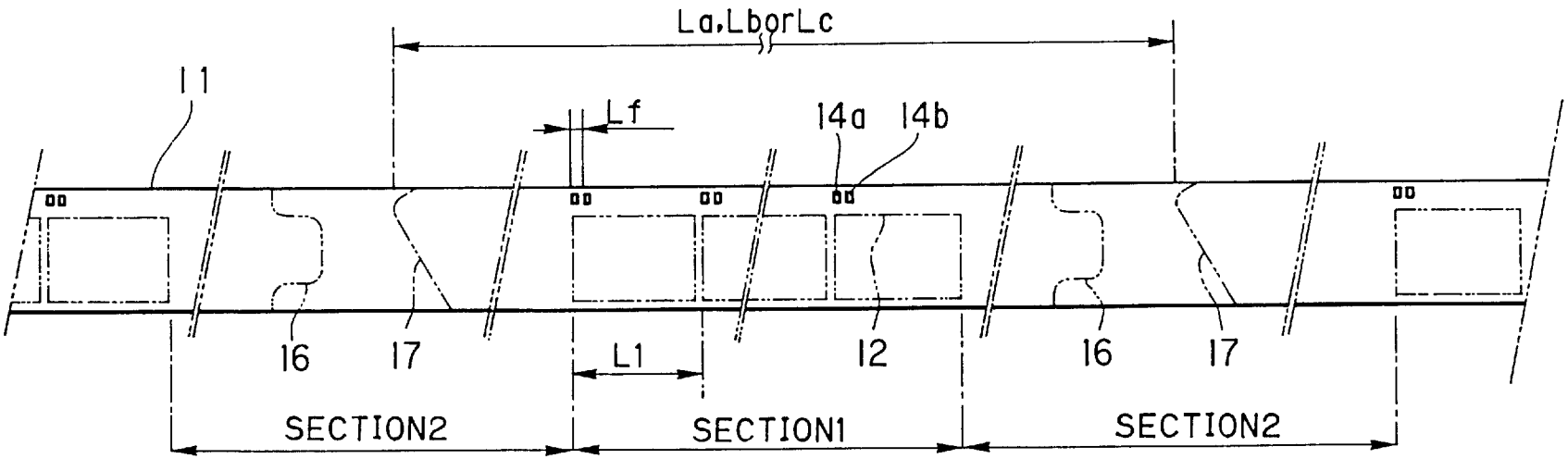
FIG. 23 is an explanatory view of a continuous film in which a pair of perforations are disposed on one lateral side of each frame exposure location.

It is known in the art that detecting more than one perforation by using more than one sensor is preferable to detecting only a single perforation by using a single sensor, in the interest of precise frame positioning. For example, according to another arrangement of frame positioning perforations as shown in FIG. 23, a pair of perforations 14*a* and 14*b* are disposed on one lateral side of each frame exposure location 12. The perforations 14*a* and 14*b* of each pair are spaced by a constant amount Lf from each other in the longitudinal direction of the continuous film 11. Whereas, the perforation pairs are spaced at the same interval L1 as the frame exposure locations 12.

Figure 24:
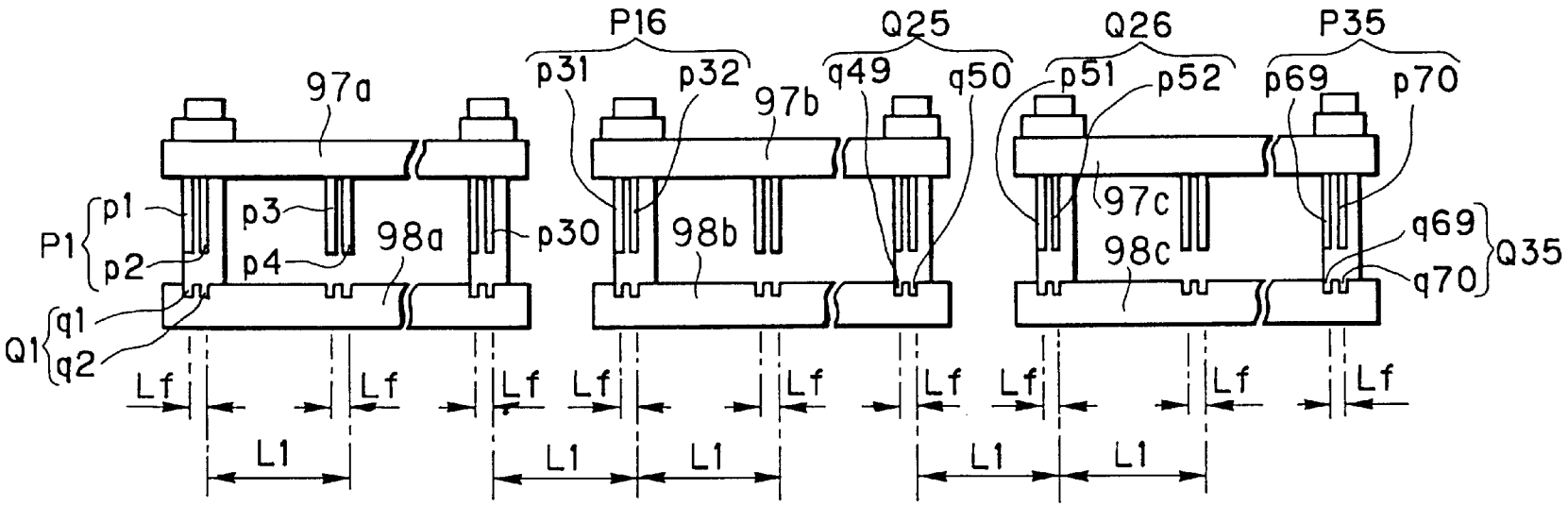
FIG. 24 is an explanatory view of a die set unit of a perforator for making perforations in the arrangement shown in FIG. 23, as a modification of the perforator shown in FIG. 16 or 22.
Figure 25:
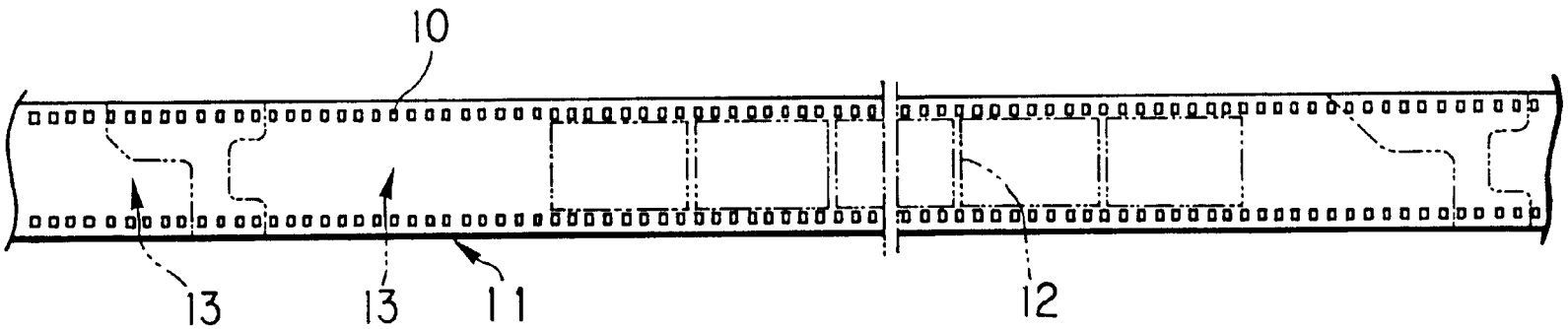
FIG. 25 PRIOR ART
FIG. 25 is an explanatory view of a continuous film in which perforations are disposed at constant intervals over the entire length of the filmstrip.

FIG. 24 shows a die set unit for making perforations in the arrangement shown in FIG. 23, wherein three punch holders 97*a*, 97*b* and 97*c* have punches p1 to p30, p31 to p50, and p51 to p70, respectively, which are arranged in pairs P1 to P15, P16 to P25, and P26 to P35 in the film transporting direction. The spacing between two punches of each pair is Lt, and the spacing between the punch pairs is L1. Dies q1 to q30, q31 to q50, and q51 to q70 are also arranged in pairs Q1 to Q15, Q16 to Q25, and Q26 to Q35 respectively in three die holders 98*a*, 98*b* and 98*c*, in correspondence with the punch pairs P1 to P15, P16 to P25, and P26 to P35. Of course, the number of punches and dies as well as the number of punch holders and die holders are variable according to the frame number variation of the film to be dealt with.

Furthermore, a cutter for cutting the continuous film 11 into individual filmstrips may be incorporated into the perforator of the invention. The cutter cuts out hatched portions shown in FIG. 17 to shape trailing and leading ends 16 and 17 of each filmstrip 99, concurrently with the die-punching process for the frame position perforations 14 or 14*a* and 14*b*. It is also possible to add other perforating devices the perforator of the present invention, to simultaneously provide other kinds of perforations, such as film leader take-up perforations 100, film end mark perforations 101, securing perforations 102 for securing the film trailing end to a spool. These perforations 100, 101 and 102 are to be formed in the ineffective recording sections 2, as shown in FIG. 17.

Although the embodiments shown in FIGS. 16, 22 and 24 relate to cases where the perforations 14 or 14*a* and 14*b* are made along one lateral side of the continuous film 11, it is alternatively possible to make the perforations 14 or 14*a* and 14*b* on both lateral sides of the continuous film 11 by suitably arranging punches and dies in double line in the respective die sets.

The perforator of the present invention is not only applicable to making perforations in photographic film, but also in a long strip of resin, paper film, sheets, or the like.

Thus, the present invention should not be limited to the embodiments shown in the drawings, but on the contrary, various modifications are possible without departing from the scope of the invention as defined by the appended claims.

What is claimed is:

1. A perforator for forming perforations at regular intervals in first sections of a continuous photographic film, said first sections alternating with second sections of a constant length along said continuous photographic film, said second sections having no perforations formed therein, said perforator comprising:

a die set having a plural number of punches and dies arranged in a feeding direction of said continuous photographic film;

an actuating device for actuating said die set to perform die-punching to form said plural number of said perforations at once through a length of A in said continuous photographic film;

a film feeder for intermittently feeding said continuous photographic film; and a main controller for controlling said film feeder and said actuating device such that when said first section has a length of N×A, N being an integer, and said constant length of said second section is B-A, said film feeder feeds said continuous photographic film intermittently (N−1) times by the length A and, thereafter, once by a length of B, and such that said die set is actuated by said actuating device after each film feeding.

2. A perforator according to claim 1, wherein said main controller is configured to control said film feeder to feed said continuous photographic film at a higher speed for the B length feeding than for the A length feeding to maintain a feeding time for each film feeding constant, and maintain a die-punching interval of said die set constant.

3. A perforator according to claim 1, wherein said main controller is configured to control said film feeder to feed said continuous photographic film at the same speed for the A length feeding and the B length feeding.

4. A perforator according to claim 1, further comprising at least a pilot pin and a die for said pilot pin which are disposed in a downstream portion of said die set in said feeding direction, and a driving device for driving said pilot pin to be inserted in said die such that a leading one of said perforations to be formed by die-punching of the die set subsequent one of said A length feedings is spaced from a trailing one of said perforations formed by the preceding die-punching of the die set in said feeding direction at said regular interval, and said pilot pin not being inserted in said die during the die-punching of said die set following the B length feeding.

* * * * *